US012654980B1

(12) United States Patent
Bigbee, Jr. et al.

(10) Patent No.: US 12,654,980 B1
(45) **Date of Patent: *Jun. 16, 2026**

(54) APPARATUS AND METHOD FOR PACKAGING WIRE OR CABLE IN A BARREL OR DRUM CONTAINER

(71) Applicant: Encore Wire Corporation, McKinney, TX (US)

(72) Inventors: William T. Bigbee, Jr., Hawkins, TX (US); John L. Rhoads, Lewisville, TX (US); Andrew P. Hull, McKinney, TX (US); Benjamin L. Weatherford, Princeton, TX (US)

(73) Assignee: Encore Wire Corporation, McKinney, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/924,449

(22) Filed: Oct. 23, 2024

Related U.S. Application Data

(63) Continuation of application No. 18/225,510, filed on Jul. 24, 2023, now Pat. No. 12,139,367, which is a (Continued)

(51) Int. Cl.
*B65H 75/22* (2006.01)
*B65H 75/14* (2006.01)
(Continued)

(52) U.S. Cl.
CPC ..... *B65H 75/2227* (2021.05); *B65H 75/14* (2013.01); *B65H 75/16* (2013.01); *B65H 75/364* (2013.01); *B65H 2701/34* (2013.01)

(58) Field of Classification Search
CPC ..... B65H 75/22; B65H 75/14; B65H 75/16; B65H 75/364; B65H 2701/34
See application file for complete search history.

(56) References Cited

U.S. PATENT DOCUMENTS 946,076 A * 1/1910 X ..... B65H 75/24 242/607
1,093,284 A * 4/1914 X ..... B65H 75/2487 242/574.1
(Continued)

OTHER PUBLICATIONS

Morse, "Morse Model 185A Kontrol-Karrier", https://morsedrum.com/products/drum-carrier-185A.htm, printed from Internet Sep. 7, 2017.

*Primary Examiner* — Victoria P Augustine
*Assistant Examiner* — Mark K Buse
(74) *Attorney, Agent, or Firm* — Warren Rhoades LLP

(57) ABSTRACT

An apparatus for the accumulation of wire or cable, the apparatus including a collapsible reel assembly, the collapsible reel assembly including a central hollow arbor, a fixed inner support structure axially centered on and rigidly attached to the central hollow arbor, wherein the fixed inner support has a first end and a second end, a fixed flange, axially centered on and attached to the first end of the fixed inner support structure, a removable flange, axially centered on and removably attached to the second end of the fixed inner support structure opposite the fixed flange and an inner drum assembly. The inner drum assembly including a plurality of moving inner support structures movably attached to the fixed inner support structure and a plurality of inwardly-collapsible drum segments. Wherein the inwardly-collapsible drum segments collapse inward after the removable flange is removed from the collapsible reel assembly.

16 Claims, 20 Drawing Sheets

Related U.S. Application Data continuation of application No. 17/190,980, filed on Mar. 3, 2021, now Pat. No. 11,738,967, which is a continuation of application No. 16/739,691, filed on Jan. 10, 2020, now Pat. No. 10,954,099, which is a continuation of application No. 16/363,906, filed on Mar. 25, 2019, now Pat. No. 10,549,945, which is a continuation of application No. 15/388,763, filed on Dec. 22, 2016, now Pat. No. 10,294,066.

(60) Provisional application No. 62/270,589, filed on Dec. 22, 2015.

(51) Int. Cl.
*B65H 75/16* (2006.01)
*B65H 75/36* (2006.01)

(56) References Cited

U.S. PATENT DOCUMENTS 1,573,183 A * 2/1926 Mehlum ..... B65H 75/2487 242/574.1
1,967,763 A * 7/1934 Melville ..... A22C 17/14 242/574
1,992,915 A * 2/1935 Hofmann ..... B65H 49/30 242/574.1
2,087,673 A * 7/1937 Lisberg ..... A22C 11/108 242/574.1
2,270,064 A * 1/1942 Littell ..... B65H 75/24 242/574.1
2,339,543 A * 1/1944 Bishop ..... B29D 30/248 242/574.1
2,711,862 A * 6/1955 Herr ..... B65H 75/2487 242/574.1
2,762,577 A * 9/1956 Herr ..... B21C 47/30 242/574.1
3,086,728 A * 4/1963 Martt ..... B65H 75/2487 242/573.7
3,326,495 A * 6/1967 De Bruyn ..... B65H 75/24 242/577
3,820,736 A * 6/1974 Moor ..... B65H 49/30 242/574.1
4,124,171 A * 11/1978 Lucke ..... B65H 54/66 242/574.3
4,300,727 A * 11/1981 Koch ..... B65H 75/2487 242/574.3
4,934,617 A * 6/1990 Lindgren ..... B65H 75/146 242/157 R
8,985,496 B2 * 3/2015 Dillinger ..... B65H 49/30 242/577.3
9,145,219 B1 9/2015 Temblador et al.
10,294,066 B1 * 5/2019 Bigbee, Jr. ..... B65H 75/14
10,315,873 B2 * 6/2019 Perini ..... B65H 19/126
10,549,945 B1 * 2/2020 Bigbee, Jr. ..... B65H 75/364
11,339,024 B1 * 5/2022 Bigbee, Jr. ..... B65H 49/32
2008/0245920 A1 * 10/2008 Houen ..... B65H 75/2245 242/407.1
2009/0152390 A1 * 6/2009 Underbrink ..... B65H 75/2487 242/577
2015/0360904 A1 * 12/2015 Swanson ..... B65H 75/2487 242/571

* cited by examiner

APPARATUS AND METHOD FOR PACKAGING WIRE OR CABLE IN A BARREL OR DRUM CONTAINER

CROSS-REFERENCE TO RELATED APPLICATIONS

This application is a continuation of U.S. application Ser. No. 18/225,510, filed Jul. 24, 2023, now issued as U.S. Pat. No. 12,139,367, issued Nov. 12, 2024, which is a continuation of Ser. No. 17/190,980, filed Mar. 3, 2021, now issued as U.S. Pat. No. 11,738,967, issued Aug. 29, 2023, which is a continuation of U.S. application Ser. No. 16/739,691, filed Jan. 10, 2020, now issued as U.S. Pat. No. 10,954,099, issued Mar. 23, 2021, which is a continuation of U.S. application Ser. No. 16/363,906, filed Mar. 25, 2019, now issued as U.S. Pat. No. 10,549,945, issued Feb. 4, 2020, which is a continuation of Ser. No. 15/388,763, filed Dec. 22, 2016, now issued as U.S. Pat. No. 10,294,066, issued May 21, 2019, which claims priority benefit to U.S. Provisional Patent Application No. 62/270,589, filed Dec. 22, 2015, all of which are hereby incorporated by reference herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present invention relates in general to electrical wire and cable, and more particularly, to packaging electrical wire and/or cable into barrel- or drum-type containers.

2. Description of Related Art

Producing packages of wire and cable products often involves the use of a coiling machine. In the context of wire or cable packaging, a coiling machine is an apparatus used to subdivide large quantities or lengths of wire or cable into smaller quantities or lengths suitable for packaging. The coiling machine achieves this subdivision by receiving an incoming feed of continuous wire or cable which it coils into a package (e.g., box, molded package, barrel, drum, etc.) or onto a take-up reel, spool, or other apparatus suited for the accumulation of wire or cable.

As the incoming feed of wire or cable approaches the coiling machine, it passes through a measuring apparatus which monitors the unit length of incoming wire or cable. When the desired quantity/length of wire or cable has been accumulated by the coiling machine, the wire or cable is cut, then the accumulated coil of wire or cable is transferred from the coiling machine into its final packaging. The coiling machine then begins the method anew, forming another coil from the incoming feed of wire or cable.

Wire or cable may be packaged in many different ways. Selection of a packaging method for a given wire or cable product depends upon various factors, including the wire or cable's diameter, relative flexibility (bending radius), and weight, as well as the length of the wire or cable to be packaged and the intended use of the finished package. Packaging methods for wire or cable may include boxes (with or without an inner spool or reel), molded plastic packaging, metallic or plastic spools, wooden spools, and—for extreme lengths of packaged wire or cable—barrels or drums.

Barrel or drum packs, as they are commonly known in the industry, range in capacity from 50-55 gallons up to 70-75 gallons. The larger barrel or drum packs can hold as much as thirty-five thousand feet (35,000') of wire or cable up to size 14 AWG, up to seventeen thousand feet (17,000') of wire or cable size 10 AWG, or up to three thousand feet (3,000') of metal-clad cable.

Wire and cable manufacturing methods typically involve multiple production steps, such as drawing, annealing, insulating, twisting, stranding, cabling, and more. The exact selection of steps (and the order in which they are carried out) depends upon the end product desired. End products may be as simple as a single bare (uninsulated) conductor, or as complex as a thermoplastic-coated, metallic-armored cable containing a dozen or more separately-bundled conductors of varying size or gauge.

Most wire or cable production steps conclude with the accumulation of intermediate or finished product on a take-up reel. Some take-up reels are appropriately sized to accumulate the proper quantity of wire or cable to fill a barrel or drum pack. However, traditional winding methods result in the wire or cable being wound so tightly on the take-up reel that it cannot easily be transferred to a barrel or drum without destroying the take-up reel in the method.

The traditional solution to this problem is to use a coiling machine, which may be set up to accumulate wire or cable into a coil that is then transferred directly into a barrel or drum. However, the use of a coiling machine to parse quantities of wire or cable for final packaging has numerous drawbacks. One such drawback is a lack of flexibility: coiling machines are not generally adaptable to accept various sizes or types of incoming wire or cable packages. Because of this limitation, coiling machines are often purpose-built, dedicated to the coiling of only one size or type of wire or cable product—or to transferring product into only one type or size of package. This results in a manufacturer incurring significant costs for, and devoting significant floor space to, different sizes and types of coiling machines in order to accommodate different types of wire or cable, or different sizes and types of packaging.

Another limitation is that coiling machines are often set up to accept the incoming wire or cable feed from a type of package known in the industry as a "stem," rather than from a reel or spool. This requires finished cable—which comes from the production line on a reel—to be transferred from said reel into a stem package before it can be fed into the coiling machine. This adds an extra production step to the manufacturing method. This same limitation also prevents the manufacturer from combining parallel streams of different conductors during the coiling step. As such, in order to package multi-conductor drums or barrels, the manufacturer must add yet another production step prior to coiling.

Yet another drawback of barrel-pack coiling machines is the manner in which finished coils are transferred from the coiling machine into a drum or barrel by force of gravity, dropping the formed coil into the container. While the coil of wire is falling, it is free to move, shift, or loosen, such that the coil may not land in the most efficient orientation for packing. This can result in the inefficient use of space, in that a looser coil means less wire or cable will fit within a given package volume. Moreover, loose coils of wire dropped into a barrel or drum may tend to loosen further and/or shift position during handling, resulting in overlapping coils which can become tangled within the barrel or drum and/or cause friction or abrasion damage to the conductors.

To address the problem of shifting or loosening coils, most barrel packs for wire or cable include an inner drum, which helps keep traditionally-formed coils in a neat arrangement as they are falling from the coiling machine, and during subsequent handling of the finished package. Unfortunately, this inner drum can interfere with wire being pulled from a traditional barrel pack by the end user. This may necessitate the use of additional guides to avoid the wire or cable wrapping around the drum during pulling, which can result in a buildup of undesirable tension in the wire or cable. Moreover, the need for an inner drum and/or additional guides also increases manufacturing costs.

A prior art solution of a coiling machine disclosed in U.S. Pat. No. 9,145,219 B1, demonstrates the inadequacies of high cost and large space requirements. Alternatively, Applicants have implemented a solution by modifying a traditional wooden reel by removing one flange from the reel then suspending said reel over a barrel or drum container, so that the force of gravity might cause the wire or cable to slide off the reel and into the container. This method fails to overcome the disadvantageous discussed herein. Traditional wooden reels require multiple fasteners to be removed before a flange can be removed. (Traditional metallic reels are less suitable in that they are welded together and thus cannot be disassembled without disrupting the integrity of the reel as a whole.) Additionally, as previously noted, the method of accumulating wire or cable onto a take-up reel typically results in wire or cable that is wrapped so tightly onto the reel that the product will not slide easily from the reel into a barrel or drum container.

Therefore, a need exists for a method and apparatus for packing wire or cable into a barrel or drum directly from a take-up reel on which it accumulates during an upstream production step. Such a method and apparatus will function without the need for a coiling machine or the separate handling steps necessitated thereby, and without the need for an inner drum in the barrel or drum package.

SUMMARY OF THE INVENTION

The invention provides for an apparatus and method for packaging wire or cable in a barrel- or drum-type container. The apparatus is a collapsible reel assembly which includes a fixed flange, a removable flange, a rigid inner support structure centered around a central hollow shaft or arbor, and a collapsible inner drum. In one embodiment, the collapsible inner drum is composed of three separate drum segments. Each collapsible drum segment is movably attached to the inner support structure. When the collapsible reel assembly is fully assembled, it functions as any typical reel that may be used to pay off or take up wire or cable. In this fully-assembled state, the collapsible drum segments are secured in a non-collapsed (outermost) position, held there between the fixed flange and the removable flange. In this state, the collapsible inner drum is at its maximum diameter. When the removable flange is removed, each collapsible drum segment collapses inward by force of gravity, coming to rest against the fixed inner structure. This collapsing movement reduces the effective diameter of the inner drum, such that any wire or cable on the reel may be easily removed from the reel without loosening or unwinding the coiled wire or cable.

The method used to transfer wire or cable from the collapsible reel assembly into a barrel or drum provides for rotating the collapsible reel assembly to a vertical position, with the removable flange facing upward. The removable flange is detached from the collapsible reel assembly, then an empty barrel or drum container is inverted and lowered, top-down, onto the reel until the wire or cable on the reel is completely enclosed by the container. Both the container and collapsible reel assembly are then rotated 180 degrees, such that the fixed flange is facing upward and the barrel or drum is upright. In this orientation, the collapsible drum segments are pulled into their innermost collapsed position, minimizing or eliminating contact between the innermost coils of wire or cable and the outer surfaces of the collapsible drum segments. The collapsible reel assembly is then lifted out of the barrel or drum container, leaving the coiled wire or cable in the barrel or drum container.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

It should be noted that the terms "wire," "cable," "wire/cable" and "wire or cable," may appear from time to time within the present disclosure. As used in the industry, "wire" and "cable" may have different meanings to different persons skilled in the art, and may not commonly be used interchangeably. For purposes of the present disclosure, however, the use of "wire" or "cable," whether separately or in combinations such as "wire/cable" or "wire/cable," are intended to be used interchangeably, unless otherwise specified.

A reel apparatus and a method for quickly transferring wire or cable directly from said apparatus into a barrel or drum under controlled conditions are disclosed herein.

Figure 1A:
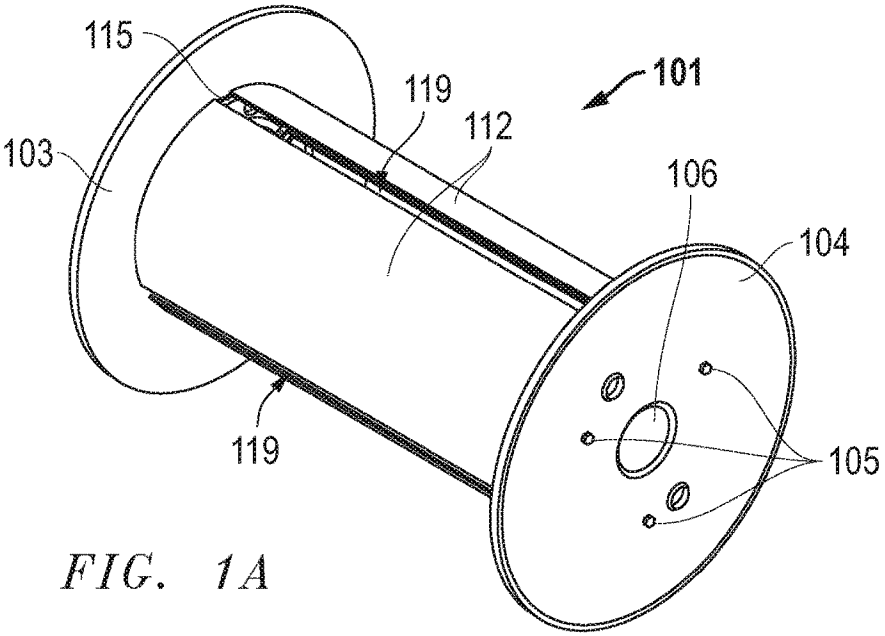
Figure 1C:
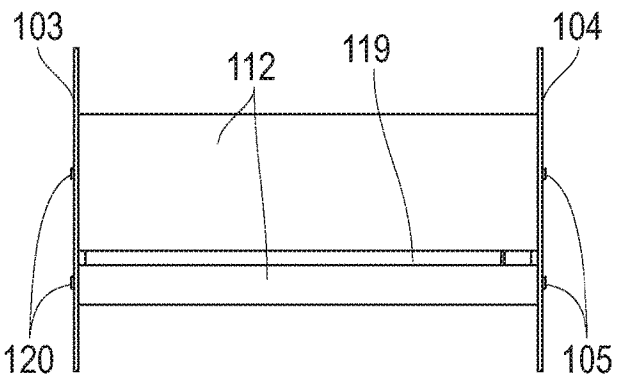
Figure 1D:
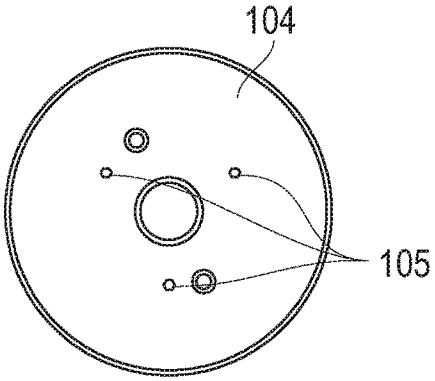
Figure 1B:
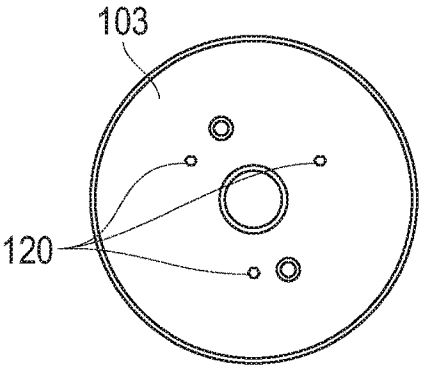
Figure 2A:
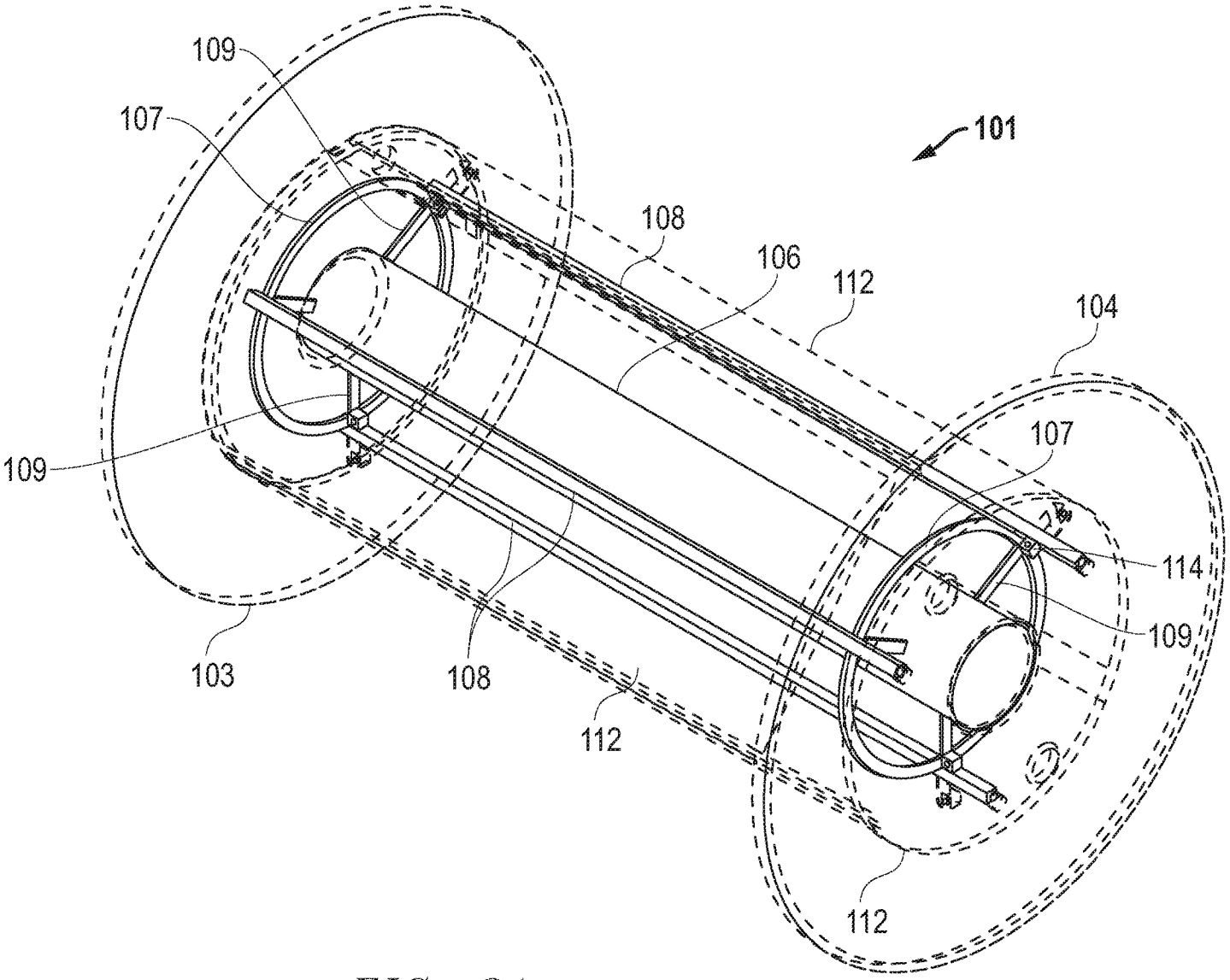
Figure 2B:
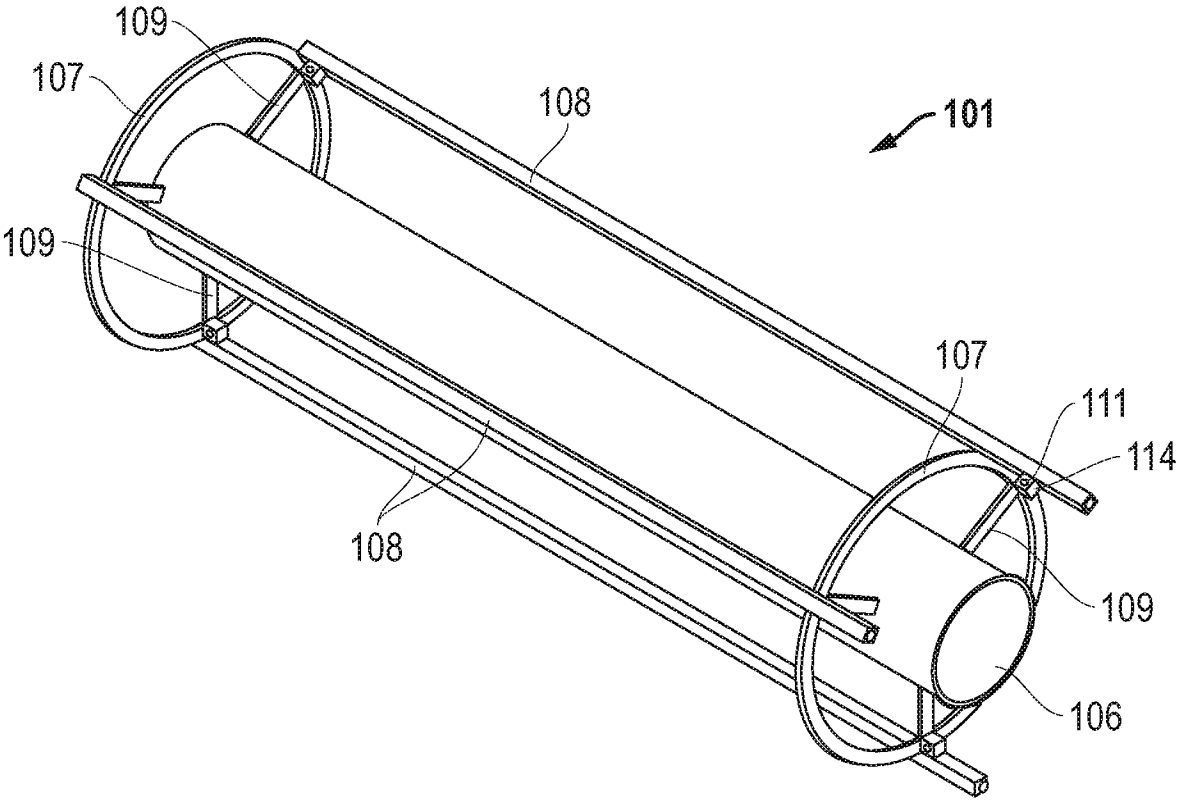
Figure 3A:
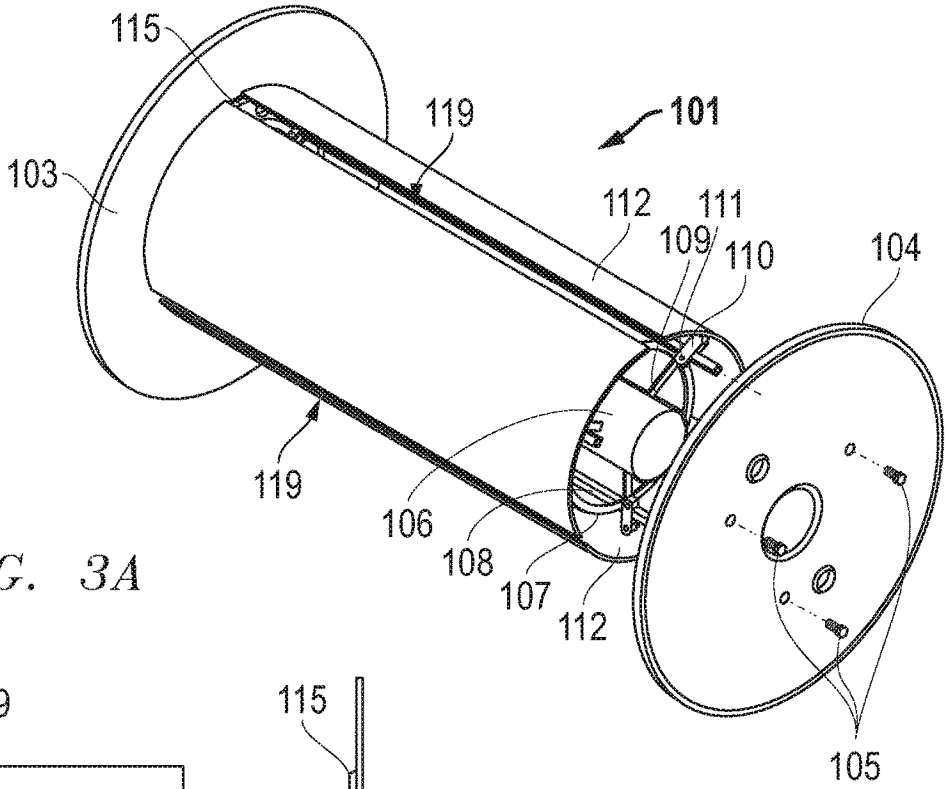
Figure 3B:
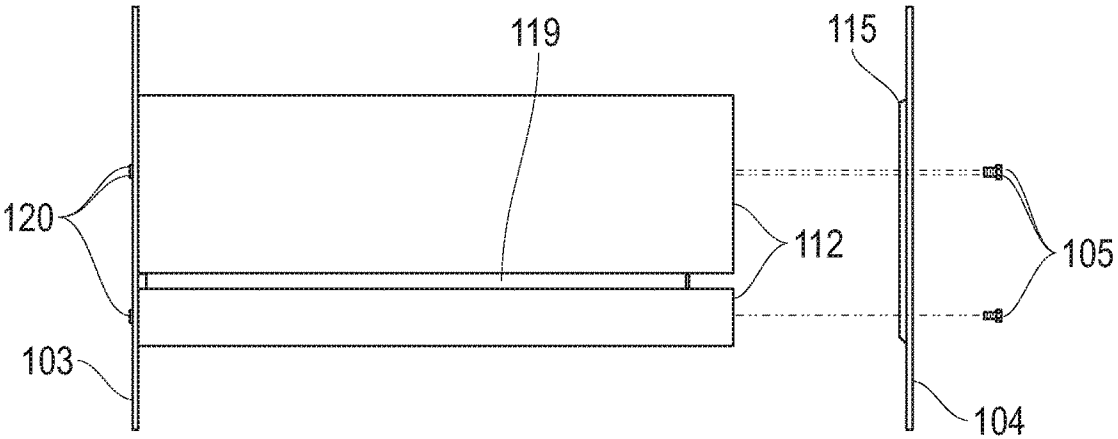
Figure 4A:
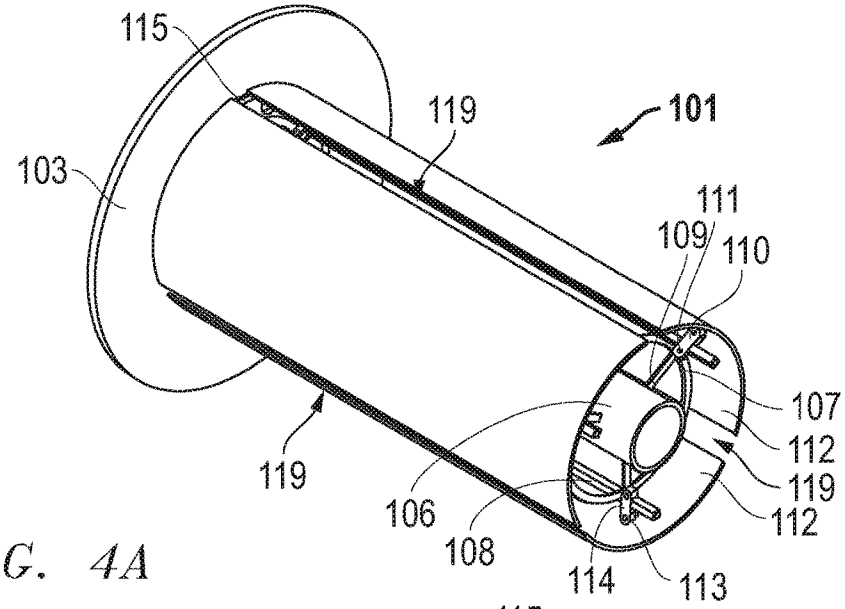
Figure 4C:
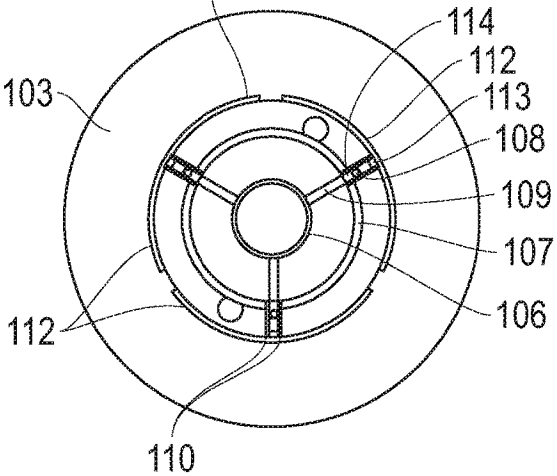
Figure 4B:
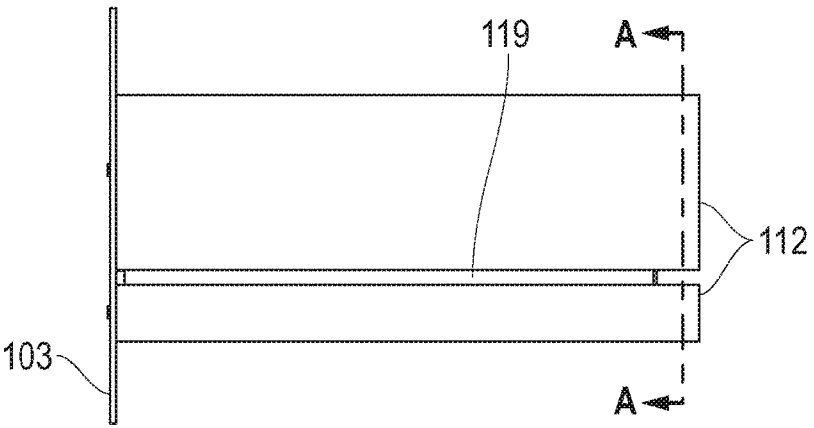
Figure 4E:
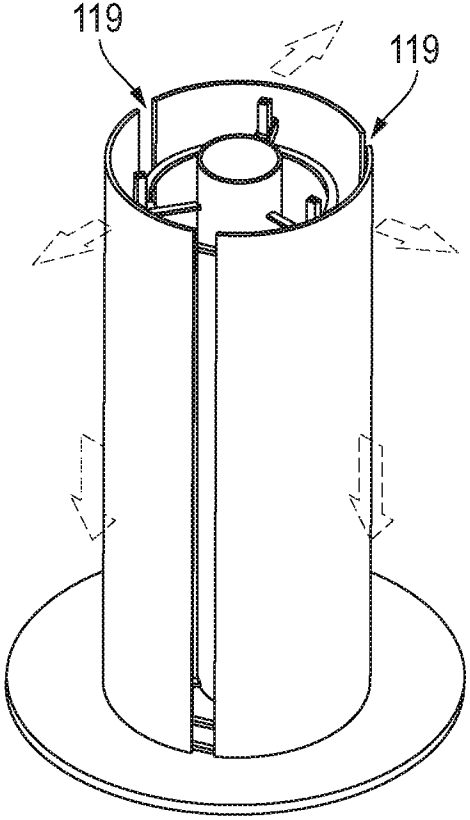
Figure 4D:
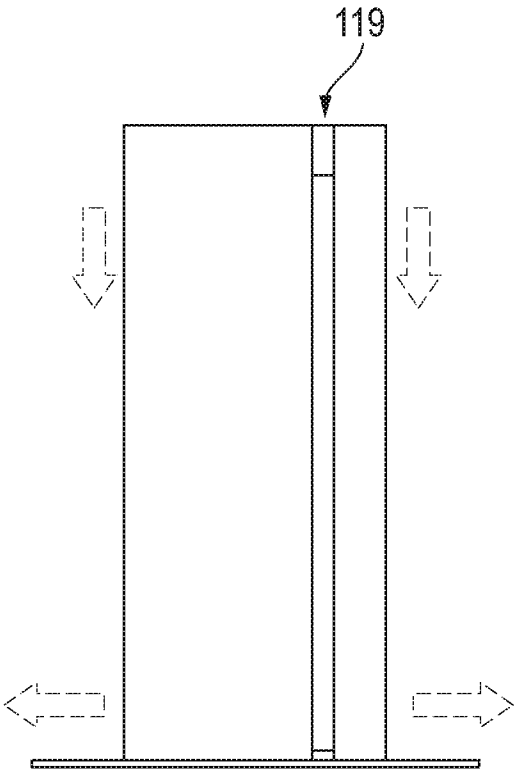
Figure 5A:
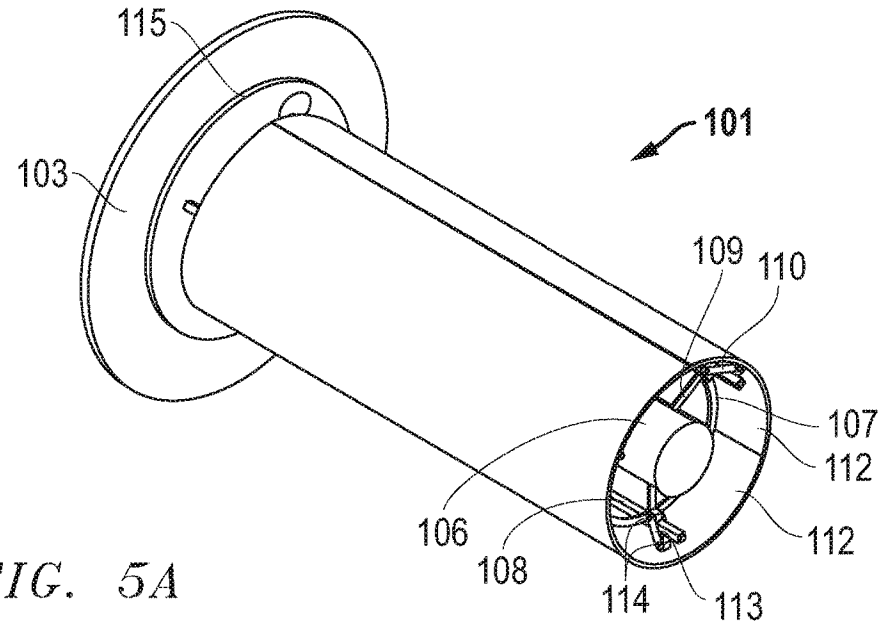
Figure 5C:
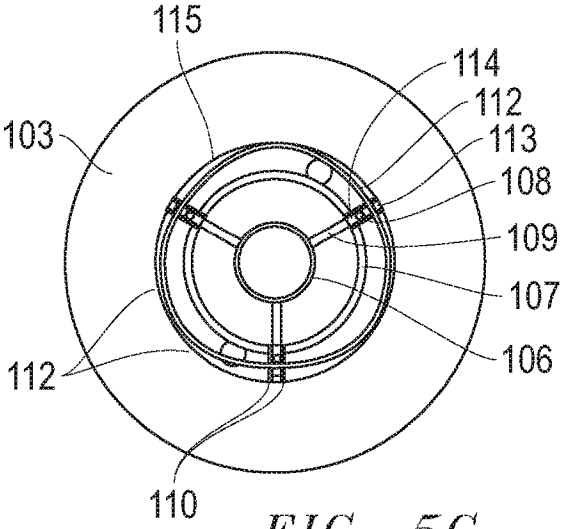
Figure 5B:
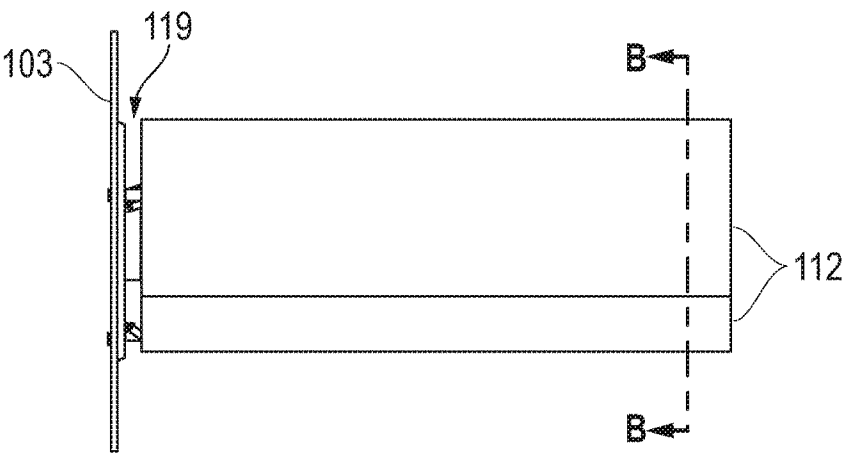
Figure 5E:
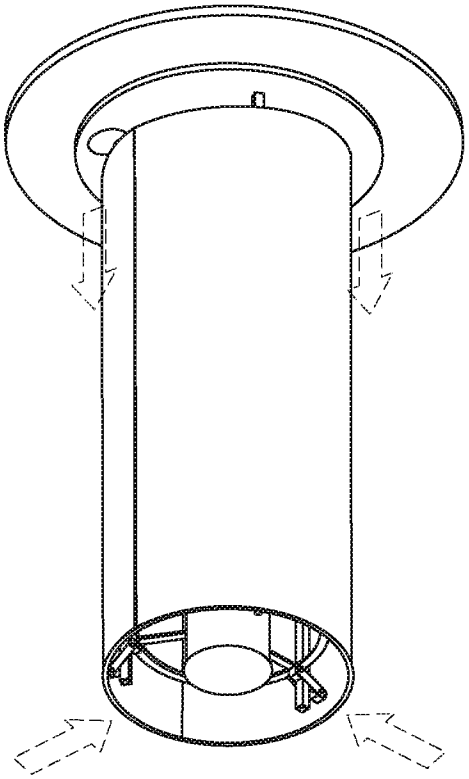
Figure 5D:
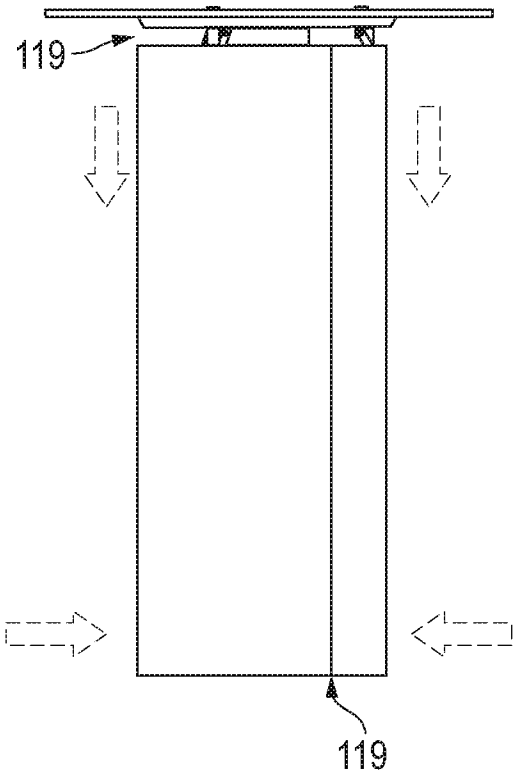
Figure 6A:
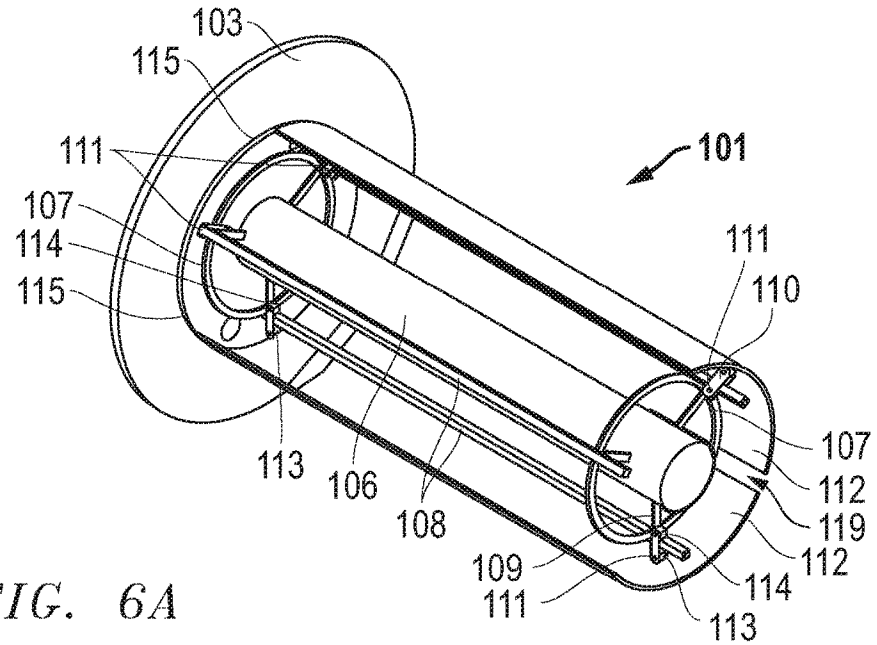
Figure 6C:
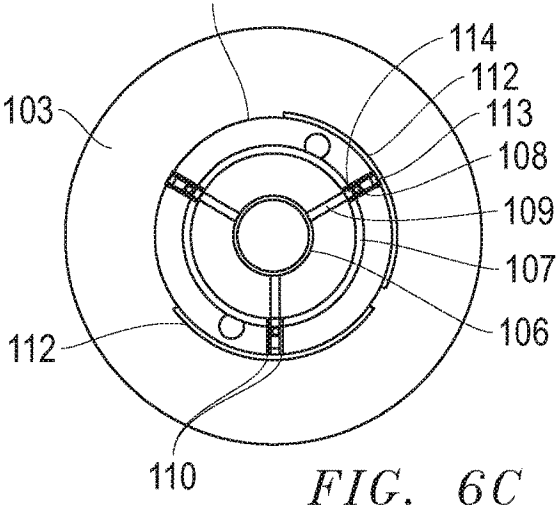
Figure 6B:
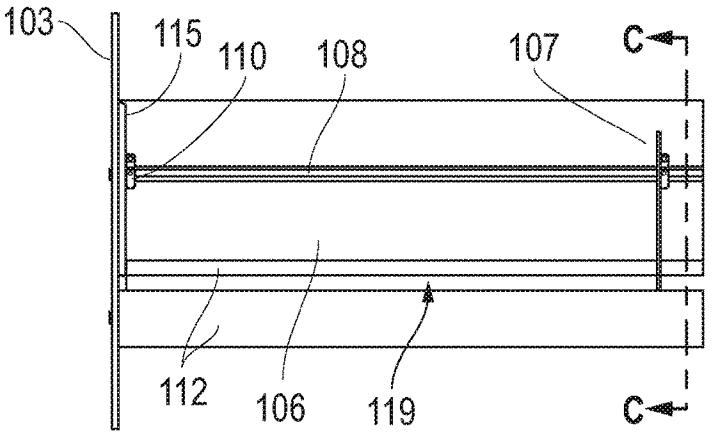
Figure 7A:
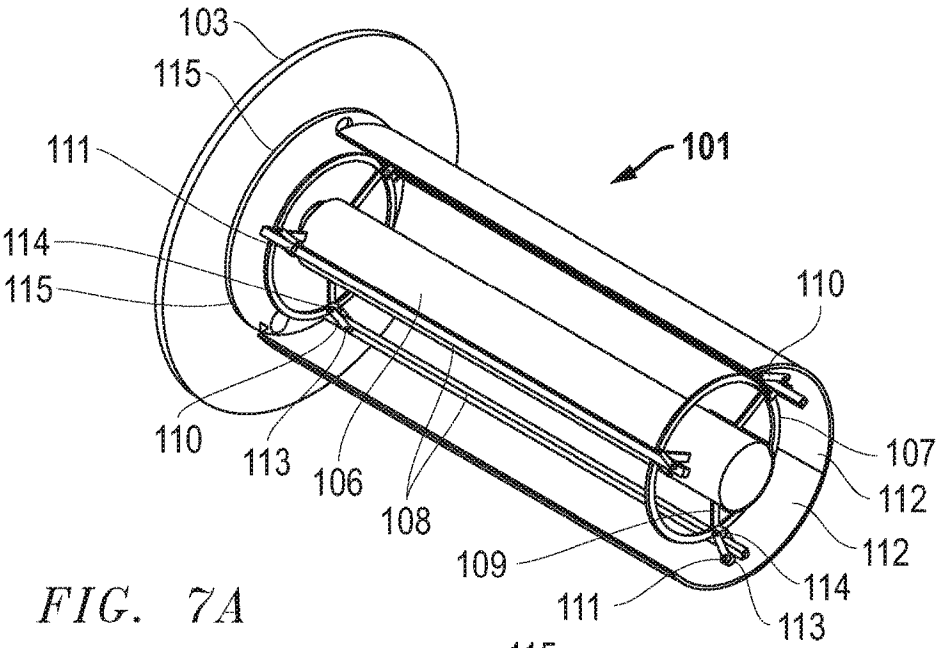
Figure 7C:
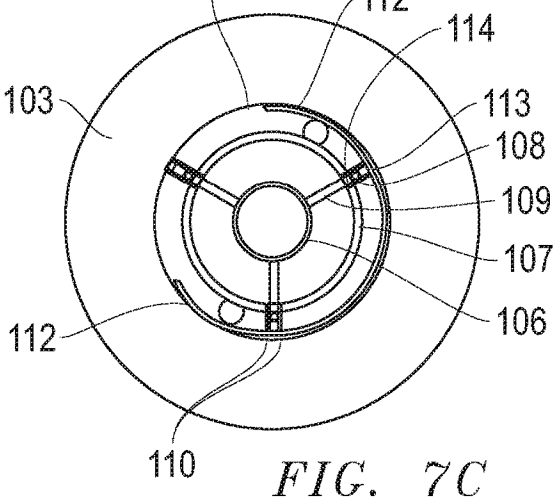
Figure 7B:
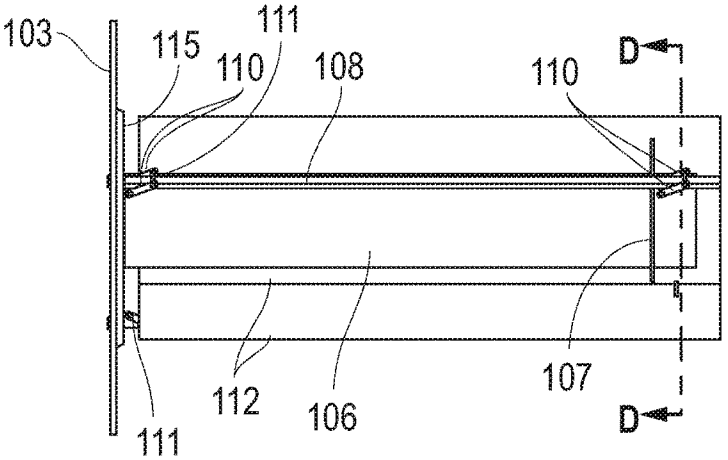
Figure 8B:
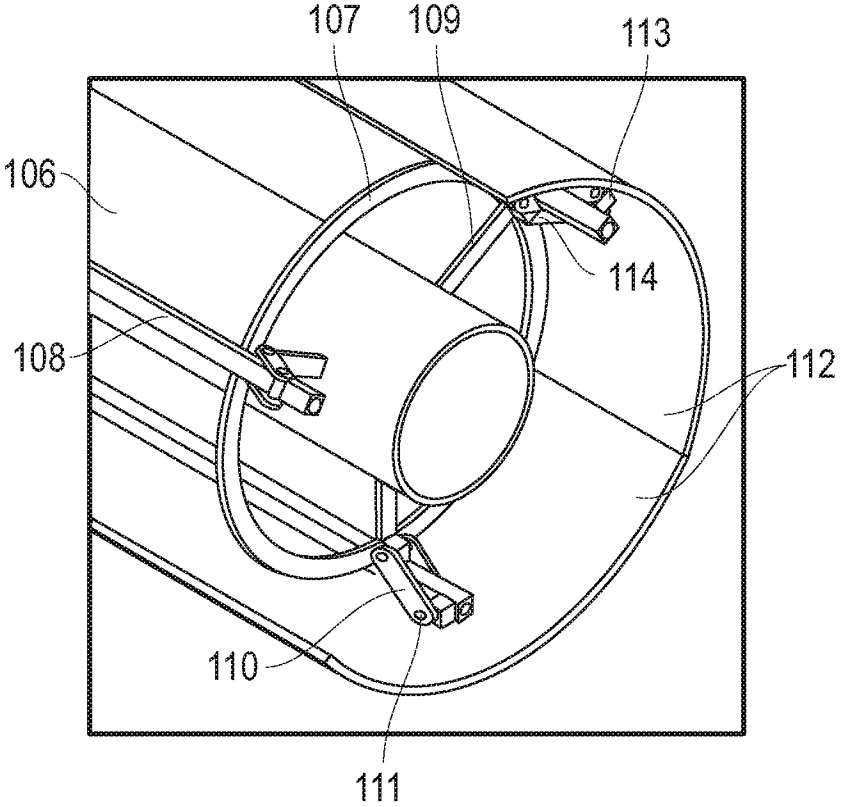
Figure 8A:
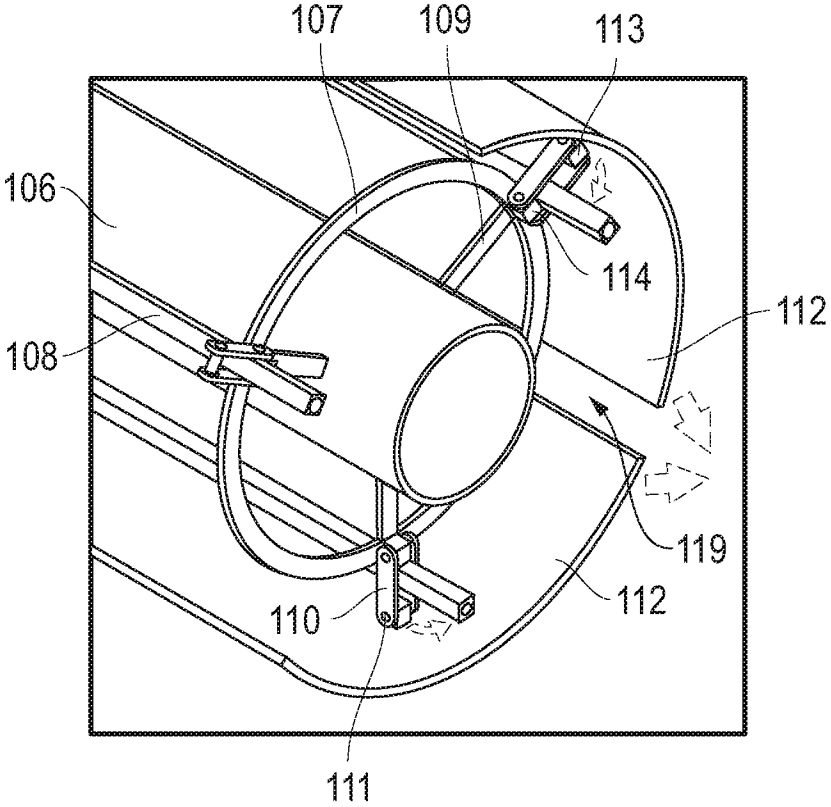
Figure 9B:
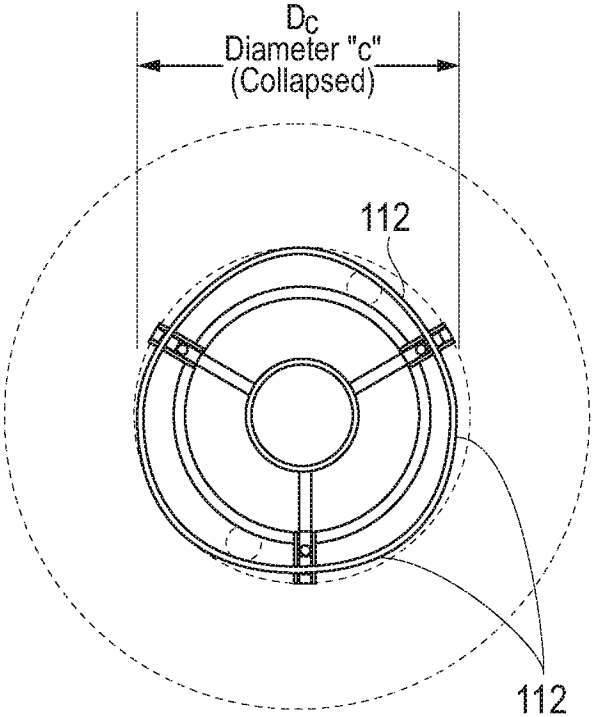
Figure 9A:
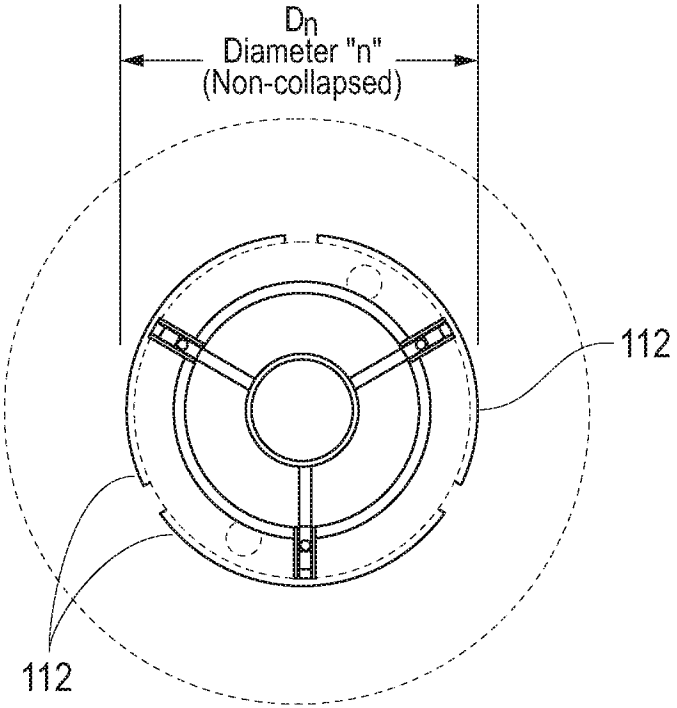
Figure 10B:
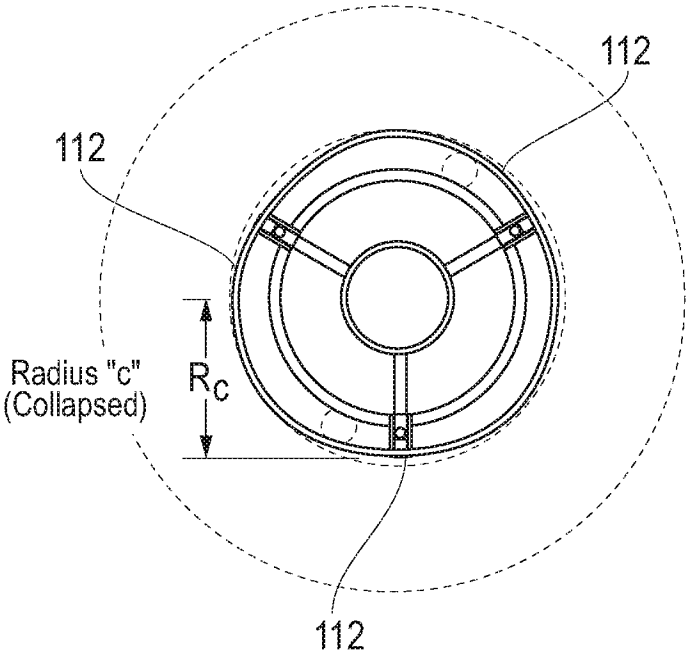
Figure 10A:
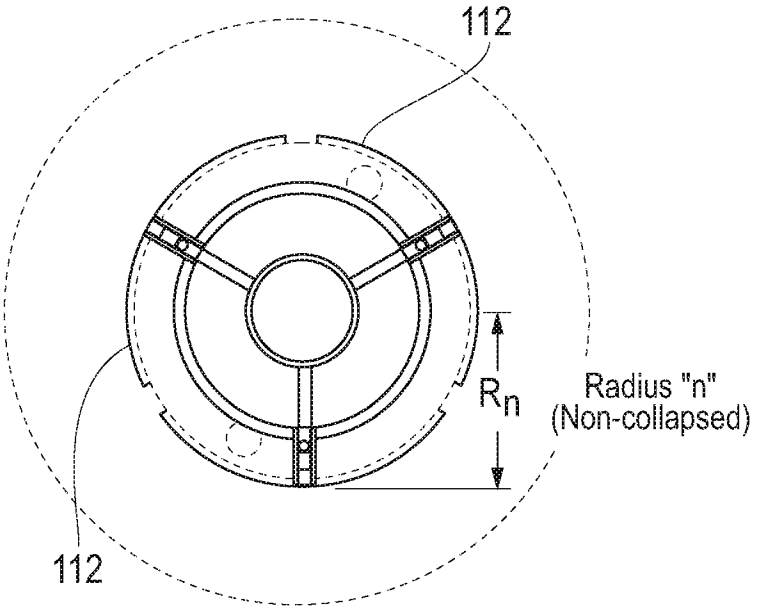
Figure 11A:
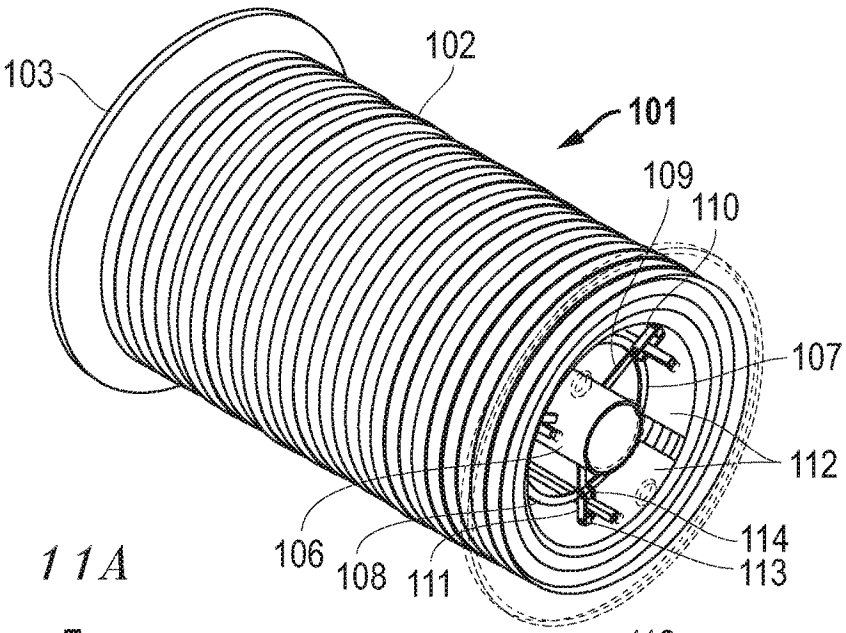
Figure 11C:
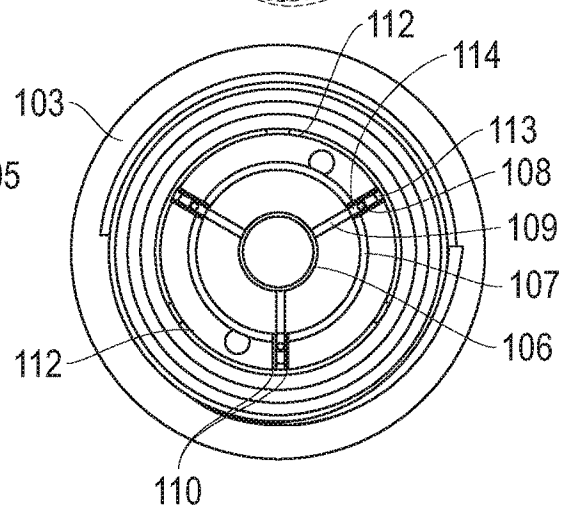
Figure 11B:
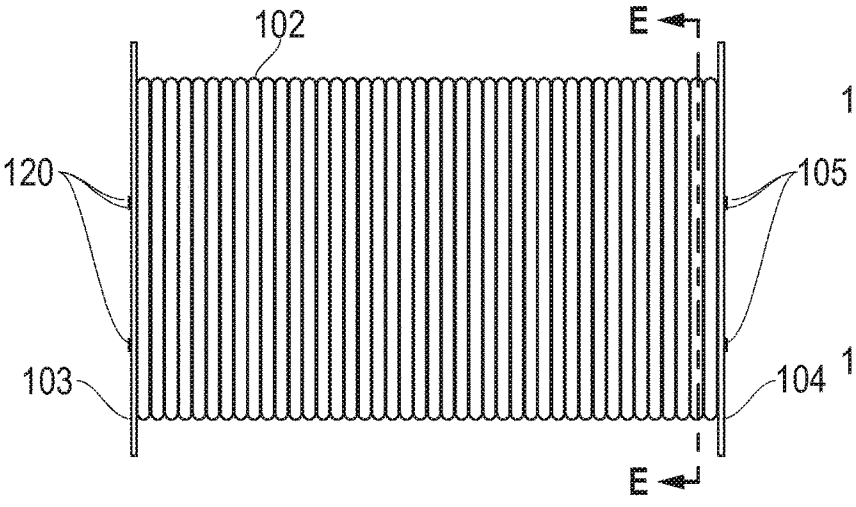
Figure 12A:
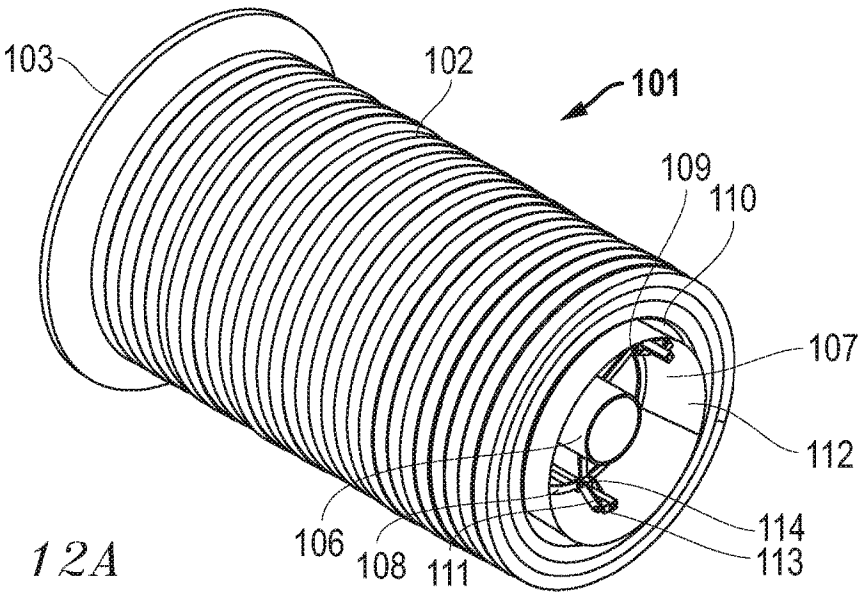
Figure 12C:
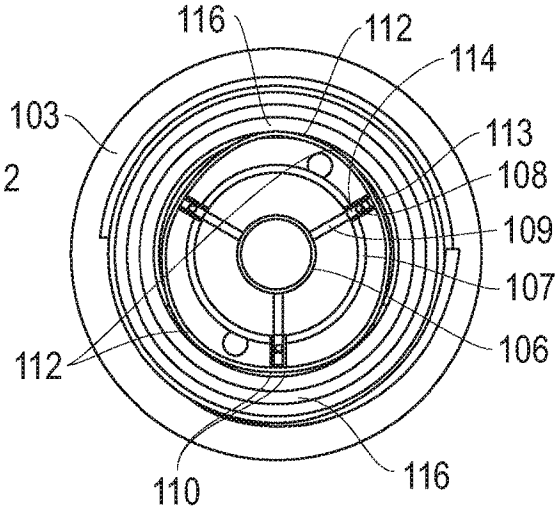
Figure 12B:
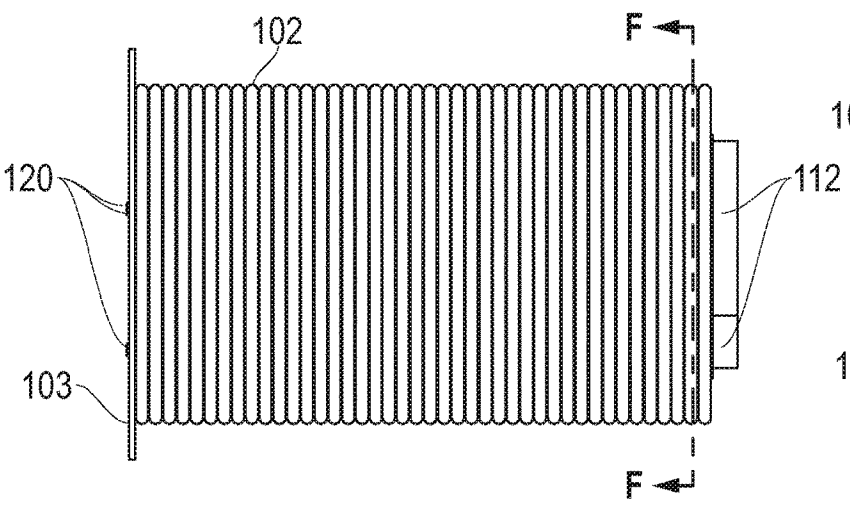
Figure 13:
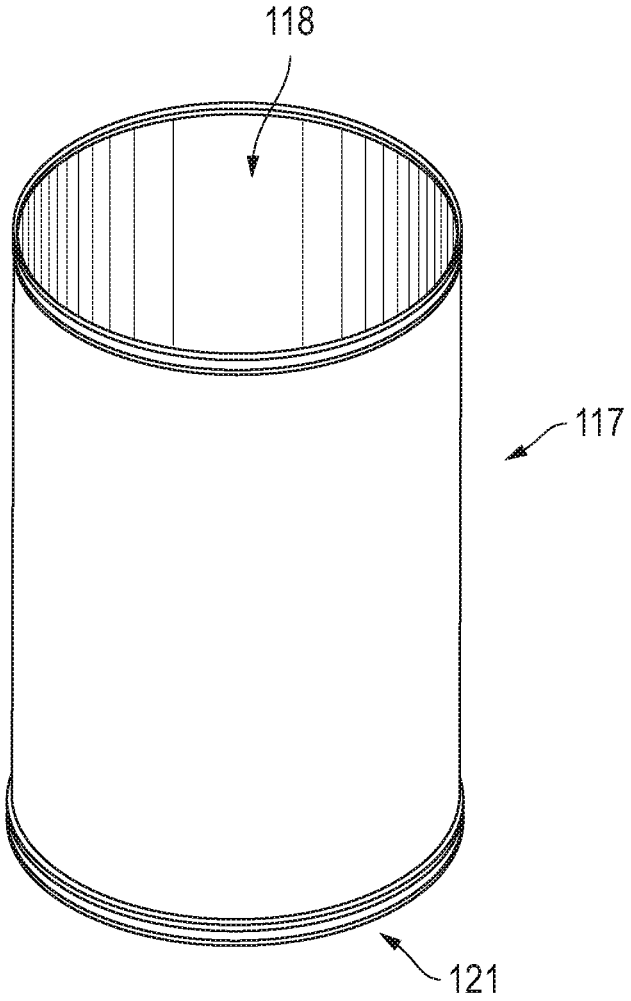
Figure 14A:
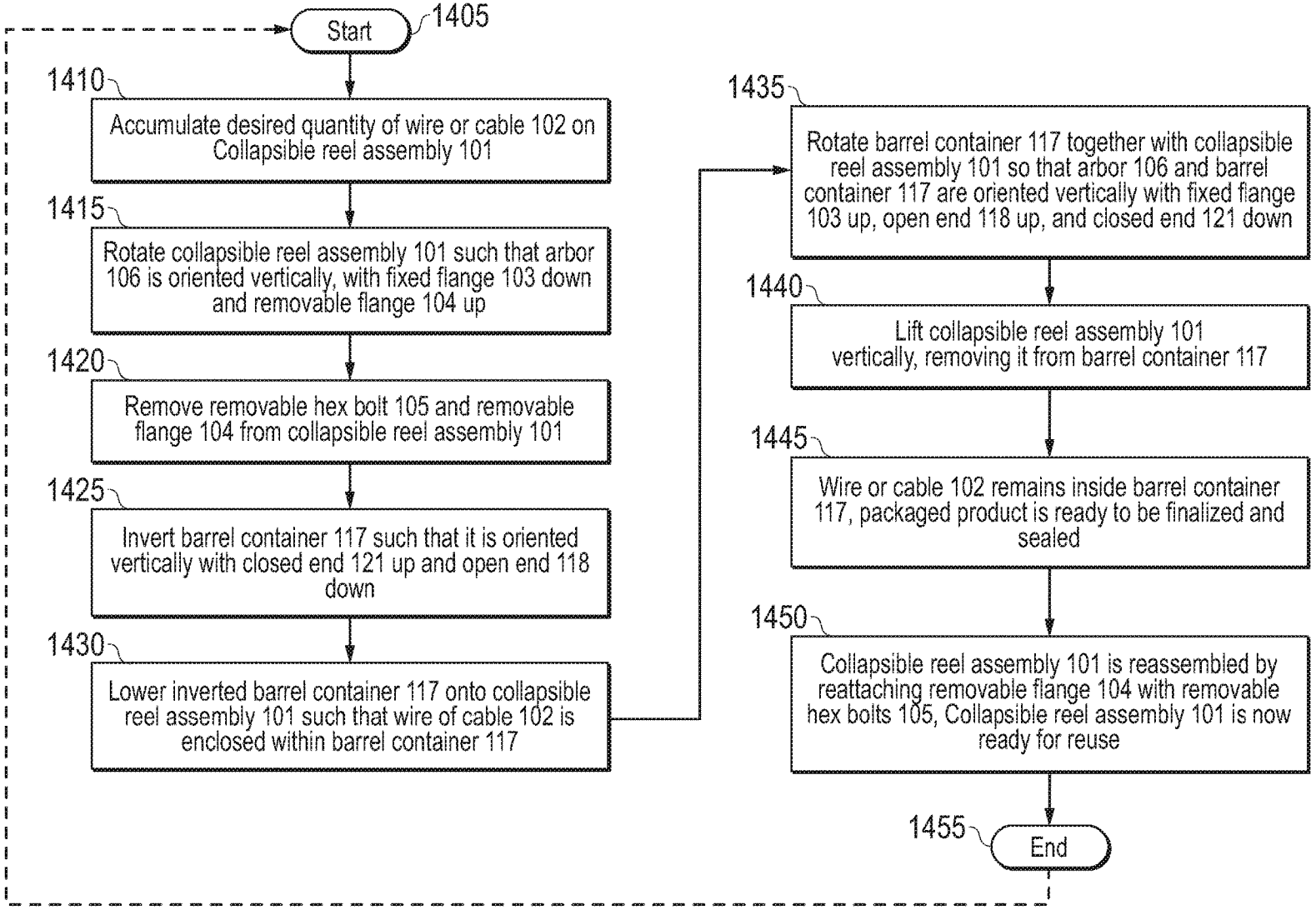
Figure 14B:
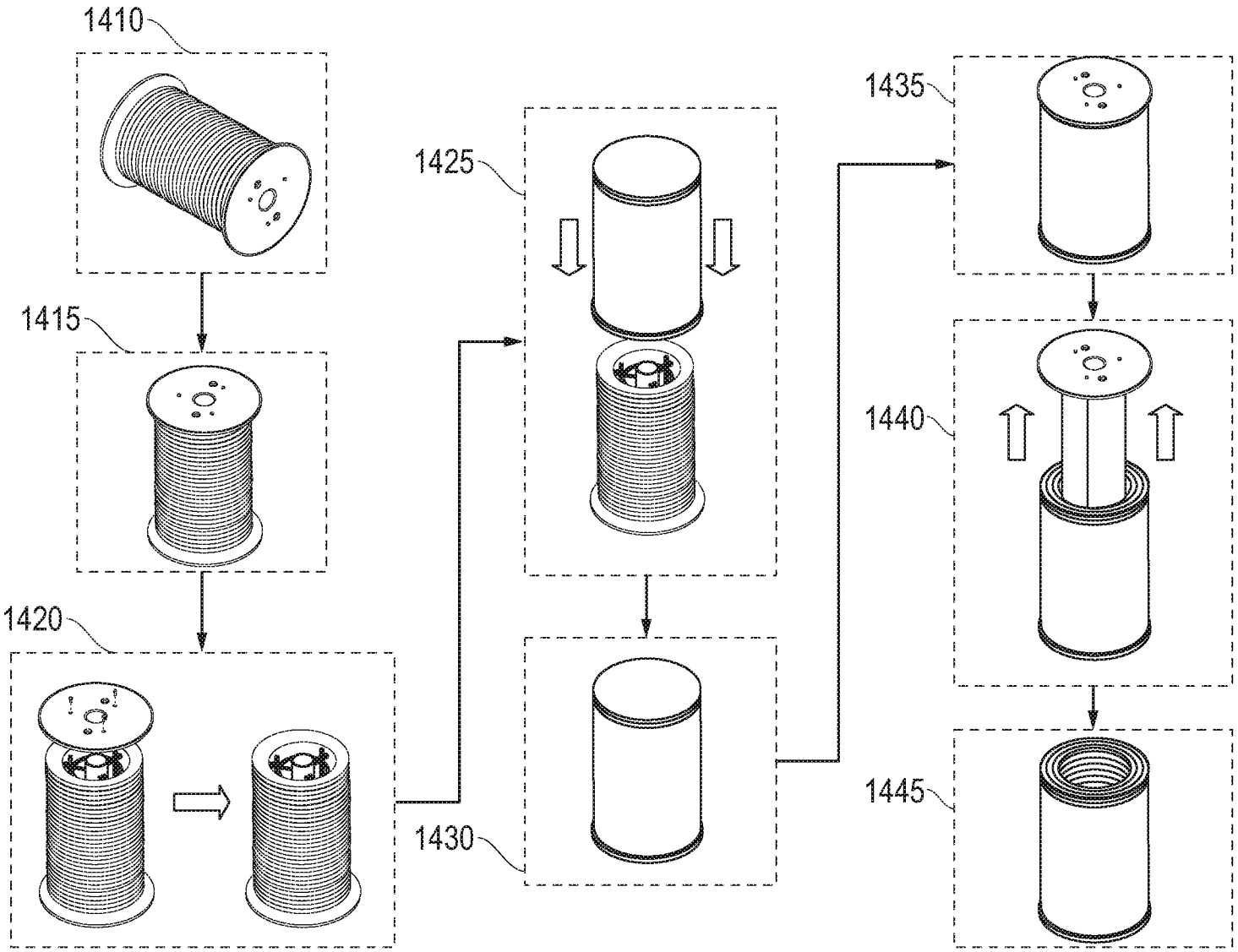
Figure 15A:
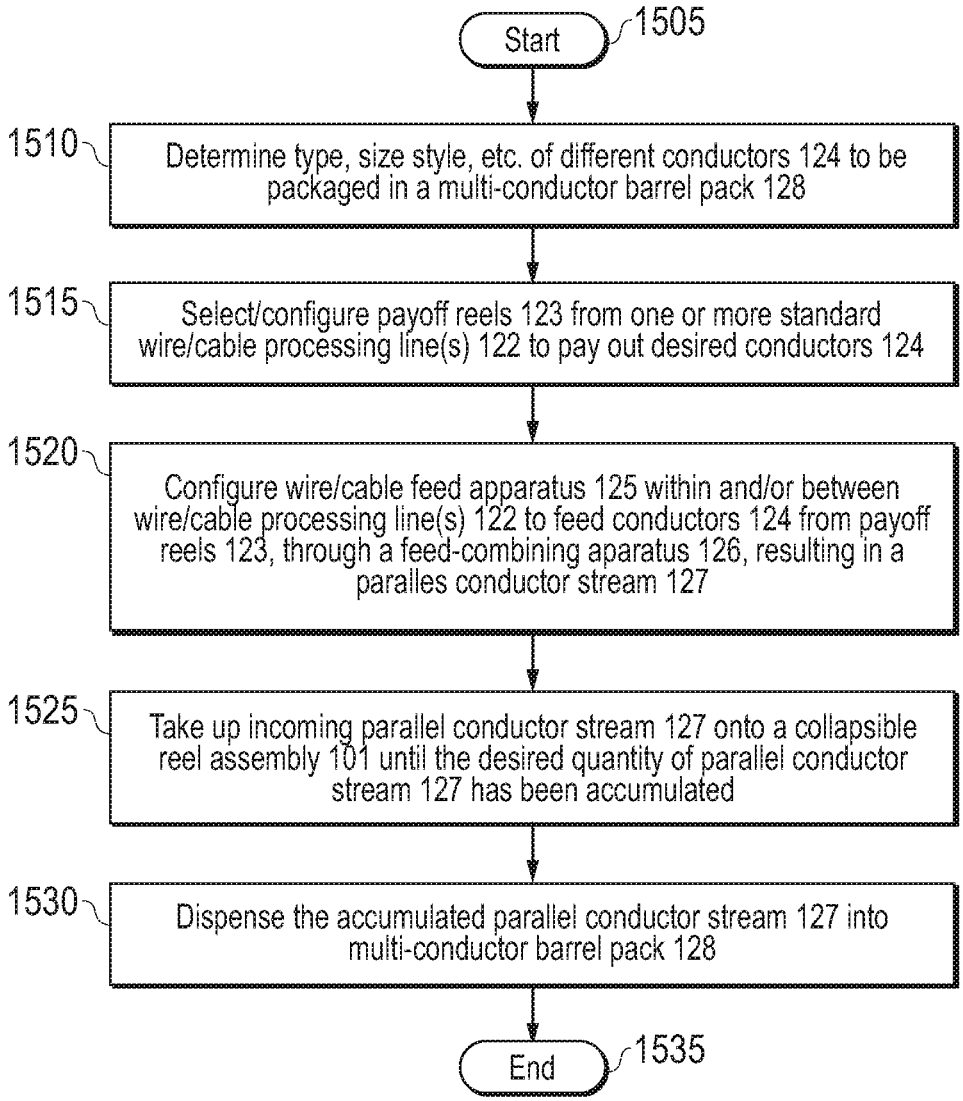
Figure 15B:
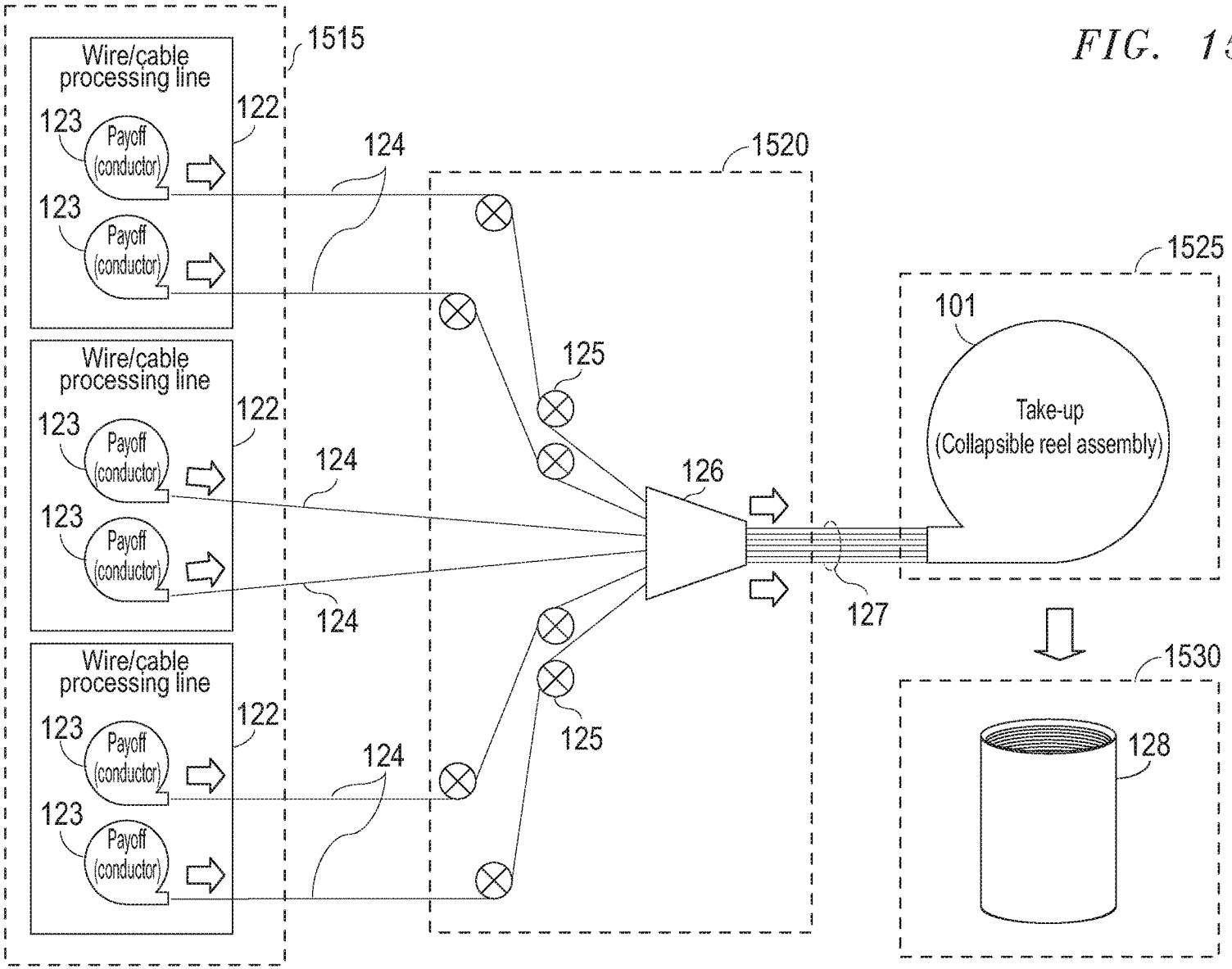

FIGS. 1A-1D are isometric, left side, front, and right side views, respectively, of one embodiment of a collapsible reel apparatus with removable flange, shown in a fully-assembled non-collapsed state;

FIG. 2A is an isometric view of one embodiment of a collapsible reel apparatus with removable flange, shown in a fully-assembled non-collapsed state, where external structures are depicted as outlines to permit visualization of the internal support structures;

FIG. 2B is an isometric view of one embodiment of a collapsible reel apparatus with removable flange, shown in a fully-assembled non-collapsed state, where external structures are depicted as dimmed outlines to better permit visualization of the internal support structures;

FIGS. 3A-3B are isometric and front views, respectively, of one embodiment of a collapsible reel apparatus with the removable flange detached;

FIGS. 4A and 4B are isometric and front views, respectively, of one embodiment of a collapsible reel apparatus with the removable flange completely removed, where the central drum sections and internal structures are in a non-collapsed state;

FIG. 4C is a section view taken along the line A-A' of FIG. 4B;

FIGS. 4D and 4E are front and isometric views, respectively, of one embodiment of a vertically-oriented collapsible reel apparatus with the removable flange completely removed, where the central drum sections and internal structures are in a non-collapsed state;

FIGS. 5A and 5B are isometric and front views, respectively, of one embodiment of a collapsible reel apparatus with the removable flange completely removed, where the central drum sections and internal structures are in a collapsed state;

FIG. 5C is a section view taken along the line B-B' of FIG. 5B;

FIGS. 5D and 5E are front and isometric views, respectively, of one embodiment of a vertically-oriented collapsible reel apparatus with the removable flange completely removed, where the central drum sections and internal structures are in a collapsed state;

FIGS. 6A and 6B are partial-cutaway isometric and front views, respectively, of one embodiment of a collapsible reel apparatus, where the central drum sections and internal structures are in a non-collapsed state and one central drum section has been removed to permit visualization of the internal structures of the apparatus;

FIG. 6C is a section view taken along the line C-C' of FIG. 6B;

FIGS. 7A and 7B are partial-cutaway isometric and front views, respectively, of one embodiment of a collapsible reel apparatus, where the central drum sections and internal structures are in a collapsed state and one central drum section has been removed to permit visualization of the internal structures of the apparatus;

FIG. 7C is a section view taken along the line D-D' of FIG. 7B;

FIG. 8A is a detail view of the apparatus of FIG. 6A;

FIG. 8B is a detail view of the apparatus of FIG. 7A;

FIG. 9A is a section view of one embodiment of a collapsible reel apparatus where the central drum sections and internal support structures are in a non-collapsed state;

FIG. 9B is a section view of one embodiment of a collapsible reel apparatus where the central drum sections and internal support structures are in a collapsed state;

FIG. 10A is a section view of one embodiment of a collapsible reel apparatus where the central drum sections and internal support structures are in a non-collapsed state;

FIG. 10B is a section view of one embodiment of a collapsible reel apparatus where the central drum sections and internal support structures are in a collapsed state;

FIGS. 11A and 11B are isometric and front views, respectively, of one embodiment of a collapsible reel apparatus with accumulated wire/cable, where the central drum sections and internal structures are in a non-collapsed state;

FIG. 11C is a section view taken along the line E-E' of FIG. 9B;

FIGS. 12A and 12B are isometric and front views, respectively, of one embodiment of a collapsible reel apparatus with accumulated wire/cable, where the central drum sections and internal structures are in a collapsed state;

FIG. 12C is a section view taken along the line F-F' of FIG. 12B;

FIG. 13 is an isometric view of a barrel- or drum-type container;

FIG. 14A is a flowchart diagram of a method for packaging wire/cable in a barrel or drum container;

FIG. 14B is a pictographic representation of the method of FIG. 14A for packaging wire/cable in a barrel or drum container;

FIG. 15A is a flowchart diagram of a method for production of a multi-conductor barrel or drum package using a collapsible reel assembly; and FIG. 15B is a pictographic representation of the method of FIG. 15A for production of a multi-conductor barrel or drum package using a collapsible reel assembly.

DETAILED DESCRIPTION OF THE INVENTION

The following discussion is presented to enable a person skilled in the art to make and use the present invention. The general principles described herein may be applied to embodiments and applications other than those specifically detailed below without departing from the spirit and scope of the present invention. Therefore, the present invention is not intended to be limited to the embodiments expressly shown, but is to be accorded the widest possible scope of invention consistent with the principles and features disclosed herein.

It should be noted that, while the present disclosure is directed primarily to the manufacture of wire/cable products, the invention and methods disclosed herein may be used to accumulate and dispense numerous other product types that are, or may be, accumulated or stored on a reel. Examples of such other product types may include, but are not limited to, tubing, pressure hoses, string, twine, rope, monofilament line, fiber optic filament, stranded fibers, textiles, paper, sheet metal, plastic films, and much more.

A traditional reel assembly typically includes a central cylinder or drum, coaxial flanges at either end and a central hollow shaft or arbor running between the flanges. The arbor provides a central axis through which the reel may be rotatably mounted to a supporting shaft, spindle, or axle. The arbor also serves to support the reel structure internally.

FIGS. 1A-4C disclose one embodiment of a collapsible reel assembly 101 in a non-collapsed state. In this embodiment, the assembly is constructed of metal, although other embodiments are anticipated in which some or all components may be fabricated from plastic, wood, or any other material(s) of sufficient strength to support the wire/cable product to be accumulated thereupon.

The collapsible reel assembly 101 includes a cylinder or drum (consisting of three collapsible drum segments 112); two flanges (fixed flange 103 and removable flange 104), and a central arbor (or shaft) 106 running between the flanges 103 and 104. The collapsible reel assembly 101 is designed and constructed to be partially disassembled and reassembled easily, without the need for specialized tools or equipment. This facilitates collapsibility of the central drum, as well as rapid reassembly and reuse of the reel.

The collapsible reel assembly 101 as shown in FIGS. 1A-1D is fully assembled. Fixed flange 103 is fastenably attached to the collapsible drum segments 112 to form the collapsible reel assembly 101. In one embodiment, the fixed flange 103 is attached to the collapsible drum segments 112 by three fixed hex bolts 120. Removable flange 104 is shown fastenably attached to the collapsible drum segments. In one embodiment, the removable flange 104 is attached to the collapsible drum segments 112 by three removable hex bolts 105. A wide variety of attachment devices or technologies may be implemented to attach the fixed and removable flanges 103 and 104 to the collapsible drum segments 112 without detracting from the spirit of the invention. The Three collapsible drum segments 112 are secured in the non-collapsed (outermost) position between fixed flange 103 and removable flange 104. In this outermost position, there are equal gaps 119 between each adjacent pair of collapsible drum segments 112. Fixed flange 103 and removable flange 104 are constructed with integral inner flange rim 115, which serves to align and support the ends of each collapsible drum segment 112 in the outermost position when collapsible reel 101 is fully assembled. When collapsible drum segments 112 are in the non-collapsed (outermost) position, they form a trisected cylinder or drum shape which serves as the central drum of the collapsible reel assembly 101.

Collapsible drum segments 112 are further supported by several internal support structures, of which some are fixed and some movable. The internal support structures contribute to the structural integrity of the collapsible reel assembly 101 as a whole, and make it possible for the collapsible drum segments 112 to collapse inward. The fixed internal support structures are rigidly attached (directly or indirectly) to arbor 106, and fastenably attached (directly or indirectly) to fixed flange 103. Taken together, the fixed internal support structures combined with arbor 106 and fixed flange 103 form a rigid structural framework for the collapsible reel assembly 101.

While the embodiments shown in the drawings depict three collapsible drum segments 112, a wide number of segments may be implemented without detracting from the spirit of the invention. The central drum may be divided into as few as two collapsible drum segments 112, or subdivided into many more than three, if practicable. It should be noted, however, that because each collapsible drum segment 112 requires fixed and movable internal support structures, increasing the number of collapsible drum segments 112 also increases the weight and mechanical complexity of the collapsible reel assembly 101 overall.

Referring now to FIGS. 2A and 2B, the orientation and assembly of the fixed internal support structures is shown. There are two circular supports 107, one positioned near each end of arbor 106. Circular supports 107 are centered axially on arbor 106 and attached thereto via three inwardly-radial spokes 109. Spokes 109 are spaced at equal angular distances from one another. In this embodiment, the number of spokes 109 per circular support 107 corresponds to the number of collapsible drum segments 112, however, a wide number of spokes may be implemented without detracting from the spirit of the invention. Depending upon the material composition and dimensions of the circular supports 107 and of the collapsible reel assembly 101 overall, the use of additional radial spokes 109 and/or other supporting structures may be desirable.

Three longitudinal supports 108 are fixedly attached to the perimeter of circular supports 107 via integral inner hinge blocks 114. The number of inner hinge blocks 114 per longitudinal support 108 corresponds to the number of circular supports 107. The inner hinge blocks 114 include a bore to accept a hinge pin 111. The longitudinal supports 108 are oriented parallel to the central axis of arbor 106, and are spaced at equal angular distances from one another. In this embodiment the number of longitudinal supports 108 corresponds to the number collapsible drum segments 112, however, a wide number of longitudinal supports may be implemented without detracting from the spirit of the invention. Depending upon the material composition and dimensions of the longitudinal supports 108 and of the collapsible reel assembly 101 as a whole, the use of additional longitudinal supports 108 and/or other fixed or moving supporting structures may be desirable.

The ends of longitudinal supports 108 include longitudinal bores that are threaded to accept hex bolts 105, 120. As shown in FIGS. 3A and 3B, fixed flange 103 is fastenably attached to longitudinal supports 108 by fixed hex bolts 120. Removable flange 104 is fastenably attached to longitudinal supports 108 by removable hex bolts 105.

During normal usage, the collapsible reel assembly 101, the removable hex bolts 105 and the removable flange 104 are detached from the collapsible reel assembly 101. The fixed flange 103 and fixed hex bolts 120 are not detached; hence the use of the terms "removable" as applied to removable hex bolts 105 and removable flange 104, and "fixed" as applied to fixed flange 103 and fixed hex bolts 120. Both fixed flange 103 and fixed hex bolts 120 may be removed from collapsible reel assembly 101 if desired for maintenance, repair, adjustment, dismantling, or other purposes. Thus, the terms "removable" and "fixed" refer to normal usage, and are not intended to constitute a limitation or requirement of construction.

Referring now to FIGS. 4A and 4C, together with FIGS. 6A-6C, the relative orientation and assembly of fixed and movable internal support structures is shown. Each collapsible drum segment 112 has a convex outer surface and a concave inner surface. The concave inner surface of collapsible drum segment 112 includes two integral outer hinge blocks 113, both of which include lateral bores to accept a hinge pin 111. Outer hinge blocks 113 are longitudinally aligned with longitudinal supports 108. The central axis of each hinge pin 111 is oriented tangentially to circular supports 107.

Each outer hinge block 113 is movably connected to an inner hinge block 114 by two link hinges 110 as follows: Each link hinge 110 includes a bore at both ends to accept a hinge pin 111. Two link hinges 110 are positioned on opposing sides of one inner hinge block 114—such that the bore hole at the medial (inner) end of each link hinge 110 aligns with the lateral bore of inner hinge block 114—where they are rotatably pinned in place by hinge pin 111. Each pair of link hinges 110 is similarly rotatably pinned at its distal (outer) end to an outer hinge block 113. Thus assembled, collapsible drum segments 112 are movably connected to, and supported by, the fixed internal structures of collapsible reel assembly 101.

Referring now to FIGS. 5A-5C, together with FIGS. 7A-8B, the relative positioning and movement of the fixed and movable structures of collapsible reel assembly 101 are shown. When collapsible drum segments 112 are in the non-collapsed (outermost) position shown in FIGS. 4A-4C, FIGS. 6A-6C, and FIG. 8A, link hinges 110 extend radially outward from, and perpendicular to, the central axis of arbor 106. In this position, outer hinge blocks 113 and collapsible drum segments 112 are at their maximum radial distance from arbor 106, circular supports 107, and longitudinal supports 108. Also in this position, the three collapsible drum segments 112 together approximate a trisected cylinder or drum shape, with equal or near equal gaps 119 between each adjacent pair of collapsible drum segments 112. As shown in FIG. 9A, the trisected cylinder or drum shape approximated by the three collapsible drum segments 112 when in the non-collapsed (outermost) position is at its maximum diameter, represented as $D_n$. Similarly, as shown in FIG. 10A, when in the non-collapsed (outermost) position, the radial distance of each collapsible drum segment 112 from the center axis of arbor 106 is at its maximum, represented as Rn.

When collapsible drum segments 112 move from the non-collapsed (outermost) position to the collapsed (innermost) position as shown in FIG. 8B, the distal ends of link hinges 110 rotate inwardly toward arbor 106, moving in an angular direction away from fixed flange 103. Because outer hinge blocks 113 are rotatably pinned to the distal ends of link hinges 110, this rotation of link hinges 110 in turn causes outer hinge blocks 113 and collapsible drum segments 112 to move laterally away from fixed flange 103 while at the same time moving inward toward arbor 106. The inward rotation of link hinges 110 and the inward movement of outer hinge blocks 113 and collapsible drum segments 112 continues until outer hinge blocks 113 come to rest against longitudinal supports 108 and collapsible drum segments 112 come into direct contact with one another. As shown in FIGS. 5B and 5D, when collapsible drum segments 112 are in this collapsed (innermost) position, there are gaps 119 between one end of each collapsible drum segment 112 and fixed flange 103, whereas the gaps 119 which existed previously between adjacent pairs of collapsible drum segments 112 have closed.

As shown in FIG. 9B, when in this collapsed (innermost) position, the three collapsible drum segments 112 no longer approximate a cylindrical shape, but instead form a collapsed, rounded triangular shape. As further shown in FIG. 9B, the diameter of an imaginary cylinder drawn tangentially to the collapsible drum segments 112, represented as $D_c$, is less than the diameter of the cylinder shape formed by collapsible drum segments 112 in the non-collapsed (outermost) position of FIG. 9A, represented as $D_n$. Similarly, as shown in FIG. 10B, the radial distance of each collapsible drum segment 112 from the central axis of arbor 106 is the minimum radius, represented as $R_c$.

In this embodiment, the above-described movement of collapsible drum segments 112, outer hinge blocks 113, and link hinges 110 between the non-collapsed (outermost) and collapsed (innermost) positions is made possible by the removal of removable flange 104 from collapsible reel assembly 101, and is effectuated by force of gravity. In another embodiment, compressed springs or some other source of motive force could cause collapsible drum segments 112 to move into the collapsed (innermost) position when removable flange 104 is detached from collapsible reel assembly 101.

As previously described, when collapsible reel assembly 101 is in a fully assembled condition as shown in FIGS. 1A-2B, collapsible drum segments 112 are secured in the non-collapsed (outermost) position between fixed flange 103 and removable flange 104. In this fully-assembled condition, collapsible drum segments 112 will remain in the non-collapsed (outermost) state regardless of whether collapsible reel assembly 101 is oriented vertically, horizontally, or at any other angle. When fully assembled, collapsible reel assembly 101 functions like a traditional reel, suitable for use as a payoff or take-up reel in any wire/cable production method for which it is appropriately sized.

When removable flange 104 is detached, however, the collapsible reel assembly 101 no longer functions as a typical reel. In this partially dismantled condition, collapsible drum segments 112 are free to move to between non-collapsed and collapsed positions, depending upon the orientation of the collapsible reel assembly 101 and the resulting effects of the force of gravity upon it. As shown in FIGS. 4D and 4E, when collapsible reel assembly 101 is rotated such that arbor 106 is oriented vertically with fixed flange 103 facing down, the force of gravity pulls downward on collapsible drum segments 112, holding them in the non-collapsed (outermost) position. In this orientation, the outward (and downward) movement of collapsible drum segments 112 is limited by their direct contact with fixed flange 103 and inner flange rim 115 at the outermost limit of travel.

Conversely, as shown in FIGS. 5D and 5E, when collapsible reel assembly 101 is inverted such that arbor 106 is oriented vertically with fixed flange 103 up, the force of gravity pulls collapsible drum segments 112 downward into the collapsed (innermost) position. In this orientation, the inward (and downward) movement of collapsible drum segments 112 is limited by edge-to-edge direct contact between collapsible drum segments 112 as by direct contact of outer hinge blocks 113 with longitudinal supports 108.

FIGS. 11A-12C show the functionality of one embodiment of a collapsible reel assembly 101 with respect to the accumulation of wire/cable thereon, as well as the removal of wire/cable therefrom for dispensing into a barrel- or drum-type container. FIGS. 11A-11C show a fully-assembled collapsible reel assembly 101. Removable flange 104 is shown semi-transparent to permit visualization of the fixed and movable inner support structures. Wire/cable 102 is shown accumulated on collapsible drum segments 112, which are in the non-collapsed (outermost) position. As FIG. 11C shows, the innermost coils of wire/cable 102 are wound snugly onto collapsible drum segments 112, such that there is no appreciable gap or spacing between the wire/cable 102 and the convex outer surfaces of collapsible drum segments 112. Subsequent layers of wire/cable 102 are similarly wound snugly onto collapsible reel assembly 101, with no appreciable gaps or spacing between adjacent layers.

As discussed herein, wire/cable 102 accumulated on a typical (non-collapsible) reel would be very difficult to remove from the reel, even with one flange removed and the reel rotated with the open end facing downward, as the friction of wire/cable 102 wrapped snugly would tend to resist the pull of gravity. Removal of wire/cable 102 from a typical reel might, in fact, be impossible without loosening the coils of wire/cable 102, or even destroying the reel entirely.

FIGS. 12A-12B show the collapsible reel assembly 101 of FIGS. 11A-11C with removable flange 104 removed. Collapsible drum segments 112 have moved into the collapsed (innermost) position. The result of the inward movement of collapsible drum segments 112 is the creation of an interstice 116 between the convex outer surface of collapsible drum segments 112 and the innermost coils of wire/cable 102. The creation of interstice 116 reduces or eliminates friction between collapsible drum segments 112 and wire/cable 102, such that when the reel rotated to a vertical orientation with fixed flange 103 upward, the wire/cable 102 will tend to slide off the collapsible reel assembly 101 with minimal resistance.

Turning now to FIGS. 13-14B, one method involving the use of a collapsible reel assembly 101 to package wire/cable 102 in a barrel- or drum-type container is disclosed. FIG. 13 shows an empty cylindrical barrel container 117 oriented vertically with closed end 121 down and open end 118 facing up. FIG. 14A depicts a method of one method for packaging wire/cable 102 in the barrel container 117. FIG. 14B is a pictographic representation of the method detailed in FIG. 14A.

The method of FIG. 14A begins with Start at step 1405. In step 1410, the accumulation of wire/cable 102 onto a collapsible reel assembly 101 is shown. This step may be accomplished using any machine or production method equipment suited for accumulating an incoming stream of product onto a reel.

The size and configuration of the collapsible reel assembly 101 used depends upon the capacity (volume) and dimensions of the barrel container 117. Determining the appropriate size and proportions of a collapsible reel assembly 101 depends primarily upon the size of the barrel container 117 with which it is to be used. A collapsible reel assembly 101 intended for use under the method disclosed herein would have a flange diameter greater than the diameter of barrel container 117, and a drum width (distance between flanges) no greater than the height of barrel container 117. The inner diameter (the diameter of the trisected drum formed by collapsible drum segments 112 when in the non-collapsed position) may vary according to the quantity and gauge (thickness) of the wire/cable 102 to be accumulated thereupon. The smaller the inner diameter, the greater the quantity of wire/cable 102 that may be accommodated.

In one embodiment, a standard 55-gallon barrel constructed of fiberboard walls with stamped sheet metal rims and base may be used. Barrels of this type as used in the wire/cable industry typically stand some 35 to 36 inches high, with a typical inside diameter of 21½ to 23 inches. Working from these typical dimensions, one example of an appropriately-sized collapsible reel assembly 101 might measure as follows: (a) Flange diameter: 24 inches; (b) Drum width (distance between flanges): 34 inches; and (c) Inner diameter: 14 inches. These are the approximate relative dimensions for collapsible reel assembly 101 and barrel container 117 as illustrated in the drawings.

In another embodiment, a standard 75-gallon barrel constructed of fiberboard walls with stamped sheet metal rims and base may be used. Barrels of this type as used in the wire/cable industry typically stand some 43 to 45 inches high, with a typical inside diameter of 211/2 to 23 inches. Working from these standard dimensions, one example of an appropriately-sized collapsible reel assembly 101 might measure as follows: (a) Flange diameter: 24 inches; (b) Drum width (distance between flanges): 42 inches; and (c) Inner diameter: 14 inches.

The difference in volume between (a) a cylinder of a diameter equal to the flange diameter of collapsible reel assembly 101; and (b) a cylinder of a diameter equal to that of the inner drum approximated by collapsible drum segments 112 in a non-collapsed state, represents the maximum volumetric quantity of wire/cable 102 that can be accumulated onto collapsible reel assembly 101. Typically, an operator accumulates a volume of wire/cable 102 onto a given reel that is less than the reel's maximum capacity. Although the volumetric capacity of a collapsible reel assembly 101 for wire/cable 102 is fixed, the linear quantity of wire/cable 102 that can be accumulated onto collapsible reel assembly 101 depends upon the gauge, or thickness, of the product to be accumulated. A given length of thicker wire/cable 102 will occupy a greater volume than a wire/cable 102 of lesser thickness.

Having determined the type and size of wire/cable 102 to be accumulated on collapsible reel assembly 101 as well as the desired volumetric and/or linear quantity thereof to be packaged in barrel container 117, the operator selects a collapsible reel assembly 101 of appropriate inner and outer dimensions. The operator may then accumulate the desired product quantity onto collapsible reel assembly 101. When the desired quantity of wire/cable 102 has been accumulated on collapsible reel assembly 101, the incoming feed of wire/cable 102 is halted, and the product cut, so that the collapsible reel assembly 101 may be removed from the method machinery in preparation for packaging. The free (cut) end of the accumulated wire/cable 102 may be secured to adjacent coils or to a flange, to prevent loosening or unspooling of the coiled product.

In step 1415, the collapsible reel assembly 101 is rotated such that arbor 106 is oriented vertically, with fixed flange 103 facing downward and removable flange 104 facing up. With collapsible reel assembly 101 thus oriented, removable hex bolts 105 are unfastened from longitudinal supports 108 and the removable flange 104 is removed from the collapsible reel assembly 101 in step 1420. In this fixed-flange-103-down orientation, the force of gravity holds collapsible drum segments 112 in the non-collapsed (outermost) position, as shown in FIGS. 4D and 4E. The outward pressure of collapsible drum segments 112 against the innermost coils of wire/cable 102 serves to stabilize the accumulated coils and hold them in position.

In step 1425, an empty barrel container 117 is inverted such that open end 118 faces downward and closed end 121 faces up. In step 1430, the inverted barrel container 117 is lowered onto the collapsible reel assembly 101, ensuring that barrel container 117 covers the accumulated coils of wire/cable 102 as it descends. When barrel container 117 is fully lowered, the open end 118 rests upon fixed flange 103, and the entirety of the accumulated wire/cable 102 is enclosed within the cylindrical walls of barrel container 117. Alternatively, the collapsible reel assembly 101 is raised into the inverted barrel container 117.

In step 1435, collapsible reel assembly 101 and barrel container 117 are both inverted as one unit, until barrel container 117 is in an upright position, with open end 118 facing upward and closed end 121 down, and with fixed flange 103 resting atop the open end 118 of the barrel container 117. In this orientation, the force of gravity pulls collapsible drum segments 112 downward into the collapsed (innermost) position, as shown in FIGS. 5D and 5E, thereby reducing the effective diameter of the three collapsible drum segments 112 and releasing them from the friction and tension of direct contact with the innermost accumulated coils of wire/cable 102.

In step 1440, the collapsible reel assembly 101 is lifted vertically and removed from the barrel container. Because the collapsible drum segments 112 are in the collapsed (innermost) position, the collapsible reel assembly 101 lifts clear of the accumulated coils of wire/cable 102, which remain inside barrel container 117 in step 1445. At this point, the wire/cable 102 has thus been transferred into barrel container 117, and the package is ready to be finalized and sealed.

In step 1450, the reassembly of collapsible reel assembly 101 is completed as follows: collapsible reel assembly 101 is again inverted so that arbor 106 is oriented vertically, with fixed flange 103 downward. In this orientation, the force of gravity once again pulls collapsible drum segments 112 down and outward into the non-collapsed (outermost) position. Removable flange 104 is replaced, then reattached to collapsible reel assembly 101 with removable hex bolts 105. Having been thus reassembled, collapsible reel assembly 101 is ready for reuse. The method Ends in step 1455. The method may begin again using the same collapsible reel assembly 101. The collapsible reel assembly 101 may be reused indefinitely to pack wire/cable 102 into barrel containers 117.

A barrel- or drum-type container 117 packed using the method disclosed herein will allow the customer to dispense the wire/cable 102 from the barrel starting from the inside of the coil. As more wire is dispensed, the innermost layer will continue to move outward toward the sides of barrel container 117. In contrast, a traditional barrel pack dispenses wire/cable product from top to bottom. Moreover, the method of the present disclosure creates better packing efficiencies compared to traditional coiling methods in that, or a given size of barrel, the disclosed method packages more wire/cable 102 per unit volume compared to typical coiling methods.

Referring now to FIGS. 15A, a method for combining and packaging multiple conductors to create a multi-conductor barrel- or drum-type package is shown. The method combines multiple incoming streams of various types of electrical conductors 124 onto a single collapsible reel assembly 101, thereby allowing combined quantities of different products to be assembled in parallel and packaged in a single multi-conductor barrel pack 128. FIG. 15B is a pictographic representation of the method of FIG. 15A.

The method begins with Start at step 1505. In step 1510, the types and quantities of different conductors 124 to be packaged in the multi-conductor barrel pack 128 are determined. As used herein, the term "conductor" is not intended to be limiting, but instead may refer to a single electrical conductor, a plurality of electrical conductors (whether separate or grouped/bundled together), or to any combination of conductors, wires, or cables suitable for accumulating together in parallel streams onto a take-up reel. Conductors, wires, cables, and/or related electrically conductive products may be manufactured in countless different types, styles, sizes, colors, configurations, etc. The exact combination of products to be combined into a given multi-conductor barrel pack 128 is determined by the operator based upon many factors, such as an end-user's need, the relative size (gauge) and type(s) of products to be combined, as well as the relative weight and durability of each, and other factors. A multi-conductor barrel pack 128 may combine several conductors of the same size and type, but with different colors of insulation; another might combine mixed types/gauges of conductors; yet another might combine several multi-circuit cables.

A pictographic representation of one embodiment of the method is shown in FIG. 15B. The method combines six conductors 124, which are fed from two payoff reels 123 situated in each of three separate wire/cable processing lines 122. The quantity of conductors, as well as the specific configuration and combinations shown are intended only as a single example; they are not intended to be construed as limiting or restrictive.

In step 1515, the number of payoff reels 123 is selected and configured, each of which contains one of the conductors 124 to be combined into a multi-conductor barrel pack 128. The payoff reels 123 used and the conductors 124 to be combined may be from a single standard wire/cable processing line 122, or from several adjacent or nearby lines. Payoff reels 123 may also be set up separately from any pre-existing wire/cable processing line 122, if necessary or appropriate. As used herein, "configuration" of selected payoff reels 123 may include adjusting the position or orientation of payoff reels 123 and verifying and adjusting the quantity of product on each payoff reel 123.

In step 1520, the wire/cable feed apparatus 125 is configured. The wire/cable feed apparatus 125 includes guides, rollers, tensioners, measuring devices, etc. that may be used to drive, redirect, tension, measure, monitor, and/or control the incoming feeds of conductors 124. The wire/cable feed apparatus 125 may be situated in or on one or more wire/cable processing lines 122, or between two or more wire/cable processing lines 122. All incoming feeds of conductors 124 from their respective payoff reels 123 are routed to a central location, where a feed-combining apparatus 126 combines said conductors 124 into a single parallel conductor stream 127.

In step 1525, the parallel conductor stream 127 is routed onto a collapsible reel assembly 101, which serves as the take-up reel for the incoming product. Accumulation of the incoming feed of parallel conductor stream 127 continues until the desired quantity of conductors 124 is accumulated on collapsible reel assembly 101.

In step 1530, the accumulated parallel conductors 124 are dispensed into a barrel container 117, using a method that takes advantage of the collapsibility feature of collapsible reel assembly 101. When the accumulated parallel conductors 124 have been dispensed into a barrel container 117, production of the multi-conductor barrel pack 128 is complete. The method Ends in step 1535.

While the multiple conductors 124 contained in the parallel conductor stream 127 are brought into close physical proximity with one another, they are not physically joined, bundled, twisted, braided, or otherwise combined together into any type of unified assembly of conductors. Rather, each conductor 124 remains a separable part of a parallel grouping. When the parallel conductors 124 are dispensed from the multi-conductor barrel pack 128 by the end-user, they emerge simultaneously but separately.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

What is claimed is:

1. An apparatus for the accumulation of wire or cable, the apparatus comprising:
- a reel assembly, the reel assembly comprising:
  - a central hollow arbor;
  - a plurality of radial spokes rigidly attached to the central hollow arbor;
  - a plurality of circular supports connected to the radial spokes, wherein the plurality of circular supports is connected to a plurality of longitudinal supports; and
  - a plurality of drum segments attached to the plurality of longitudinal supports, wherein the number of longitudinal supports is equivalent to the number of collapsible drum segments.

2. The apparatus of claim 1, wherein the reel assembly is metal.

3. The apparatus of claim 1, wherein the reel assembly is wood.

4. The apparatus of claim 1, wherein the reel assembly is plastic.

5. The apparatus of claim 1, wherein the plurality of circular supports are connected to a plurality of longitudinal supports.

6. The apparatus of claim 5 further comprising a plurality of collapsible drum segments attached to the plurality of longitudinal supports.

7. The apparatus of claim 6, wherein the number of longitudinal supports is equivalent to the number of collapsible drum segments.

8. The apparatus of claim 1 further comprising a fixed flange axially centered on and attached to the longitudinal supports.

9. The apparatus of claim 8, wherein the fixed flange is attached to the longitudinal supports with a bolt.

10. The apparatus of claim 8, wherein the fixed flange is attached to the longitudinal supports with at least three bolts.

11. The apparatus of claim 1, wherein the plurality of longitudinal supports are spaced at equal angular distances from one another.

12. The apparatus of claim 1, wherein the drum segments comprise:
- a convex outer surface;
- a concave inner surface; and
- a plurality of radial outer hinge blocks rigidly attached to the concave inner surface of the drum segments;
- wherein the radial outer hinge blocks are rotatably connected to the distal ends of each pair of the link hinges with a hinge pin.

13. The apparatus of claim 12, wherein the radial outer hinge blocks each comprising a smooth borehole oriented tangentially to the curvature of the drum segment to which it is attached and sized to accept a pin.

14. The apparatus of claim 13, wherein the pin includes a hinge pin extending outward from both ends of the smooth borehole.

15. The apparatus of claim 1, wherein the drum segments form longitudinal spaces between each drum segment.

16. The apparatus of claim 1, wherein the drum segments are in close proximity to other drum segments.

* * * * *